US006813133B2

(12) United States Patent
Yasuoka et al.

(10) Patent No.: US 6,813,133 B2
(45) Date of Patent: Nov. 2, 2004

(54) SWITCH, INTEGRATED CIRCUIT DEVICE, AND METHOD OF MANUFACTURING SWITCH

(75) Inventors: Masazumi Yasuoka, Tokyo (JP); Masaru Miyazaki, Tokyo (JP)

(73) Assignee: Advantest Corporation, Tokyo (JP)

( * ) Notice: Subject to any disclaimer, the term of this patent is extended or adjusted under 35 U.S.C. 154(b) by 0 days.

(21) Appl. No.: 10/630,105

(22) Filed: Jul. 30, 2003

(65) Prior Publication Data

US 2004/0022044 A1 Feb. 5, 2004

Related U.S. Application Data

(63) Continuation of application No. PCT/JP02/00263, filed on Jan. 17, 2002.

(30) Foreign Application Priority Data

Jan. 30, 2001 (JP) ..... 2001-021092

(51) Int. Cl.[7] ..... H01B 7/10
(52) U.S. Cl. ..... 361/232; 361/233; 335/78
(58) Field of Search ..... 361/232, 233, 361/760; 335/78; 200/181

(56) References Cited

U.S. PATENT DOCUMENTS

| | | | | | |
|---|---|---|---|---|---|
| 5,268,696 | A | * | 12/1993 | Buck et al. | 342/372 |
| 5,619,177 | A | * | 4/1997 | Johnson et al. | 337/140 |
| 6,046,659 | A | * | 4/2000 | Loo et al. | 333/262 |
| 6,236,300 | B1 | * | 5/2001 | Minners | 337/139 |
| 6,621,387 | B1 | * | 9/2003 | Hopcroft | 333/262 |

FOREIGN PATENT DOCUMENTS

| | | | |
|---|---|---|---|
| JP | 7-45175 | 2/1995 | H01H/59/00 |
| JP | 8-506690 | 7/1996 | H01H/59/00 |
| JP | 8-255546 | 10/1996 | H01H/59/00 |
| JP | 9-213191 | 8/1997 | H01H/59/00 |
| JP | 11-232987 | 8/1999 | H01H/59/00 |
| JP | 2000-309000 | 11/2000 | B81B/3/00 |
| JP | 2002-100276 | 4/2002 | H01H/59/00 |
| WO | WO 99/16096 | 4/1999 | H01H/61/00 |

OTHER PUBLICATIONS

Patent Abstracts of Japan, Publication No. 09–213191, date of publication Aug. 15, 1997; 1 pg.
Patent Abstracts of Japan, Publication No. 11–232987, date of publication Aug. 27, 1999; 1 pg.
Patent Abstracts of Japan, Publication No. 2002–100276; date of publication Apr. 5, 2002, 1 page.
Patent Abstracts of Japan, Publication No. 07–045175; date of publication Feb. 14, 1995; 1 page.
Patent Abstracts of Japan, Publication No. 08–255546; date of publication Oct. 1, 1996; 1 pg.
Patent Abstracts of Japan, Publication No. 2000–309000, date of publication Nov. 7, 2000; 1 pg.
International Search Report dated Apr. 6, 2002, 2 pgs.
Japanese International Preliminary Examination Report for Application No. PCT/JP02/00263 dated Feb. 13, 2002, 6 pages, along with Translation of same, 7 pages.

* cited by examiner

*Primary Examiner*—Tulsidas Patel
*Assistant Examiner*—Hung S. Bui
(74) *Attorney, Agent, or Firm*—Osha & May L.L.P.

(57) ABSTRACT

There is provided a switch 10 for connecting a first terminal with a second terminal electrically. The switch 10 includes: the first terminal 46; the second terminal 26 and a third terminal 28 confronting said first terminal 46; driving means 70 for driving the first terminal 46 in the direction of the second terminal 26 and the third terminal 28; and an electrostatic coupling section 72 including a first electrode 50 and a second electrode 30 confronting each other for attracting the first terminal 46 in the direction of the second terminal 26 and the third terminal 28 by electrostatic force.

20 Claims, 16 Drawing Sheets

SWITCH, INTEGRATED CIRCUIT DEVICE, AND METHOD OF MANUFACTURING SWITCH

The present application is a continuation application of PCT/JP02/00263 filed on Jan. 17, 2002, claiming priority from a Japanese patent application No. 2001-21092 filed on Jan. 30, 2001, the contents of which are incorporated herein by reference.

BACKGROUND OF THE INVENTION

1. Field of the Invention

The present invention relates to a switch, an integrated circuit device, and a manufacturing method of a switch.

2. Related Art

Bimetal, composed of a plurality of metals having different coefficients of thermal expansion and being bonded together, is used for a switch using micro machine technology. By heating the bimetal, the switch using the bimetal deforms the bimetal and keeps the switch being closed. In order to put such the switch of the micro machine device in practical use, it is important to reduce the electric power consumption of the switch.

However, to keep the switch using bimetal closed, it needs to include means for heating the bimetal. Consequently, there has been a problem that the electric power consumption has become large.

SUMMARY OF THE INVENTION

Therefore, it is an object of the present invention to provide a switch, an integrated circuit device, and a method of manufacturing a switch which can solve the foregoing problem. The above and other objects can be achieved by combinations described in the independent claims. The dependent claims define further advantageous and exemplary combinations of the present invention.

In order to solve the foregoing problem, according to the first aspect of the present invention, there is provided a switch for connecting a first terminal with a second terminal electrically. The switch includes: the first terminal; the second terminal confronting the first terminal; driving means for driving the first terminal in the direction of the second terminal; and an electrostatic coupling section including a first electrode and a second electrode confronting each other for attracting the first terminal in the direction of the second terminal by electrostatic force.

The driving means may drive the first terminal in the direction of the second terminal by electric power supply. The switch may further include electric power supply means for supplying electric power to at least either the driving means or the electrostatic coupling section.

The switch may further include a third terminal confronting the first terminal, and the first terminal may connect the second terminal with the third terminal electrically by the first terminal contacting the second terminal and the third terminal. The driving means may include a moving section which hold the first terminal and is driven in the direction of the second terminal.

The switch may further include: a wiring provided at the moving section with one end of the wiring connecting with the first terminal; and a third terminal connecting with another end of the wiring, and the first terminal, the first terminal may connect the second terminal with the third terminal electrically by contacting the second terminal.

The switch may further include: a wiring provided at the moving section with one end of the wiring connecting with the first terminal; a third terminal connecting with another end of the wiring; and a fourth terminal confronting the third terminal, and the driving means may drive the third terminal in the direction of the fourth terminal, and the electrostatic coupling section may further include a third electrode and a fourth electrode confronting each other for attracting the third terminal in the direction of the fourth terminal by electrostatic force.

The switch may further include a supporting section for supporting the moving section, and the first terminal may be provided between the supporting section and the first electrode. The switch may further include a supporting section for supporting the moving section, and the first electrode may be provided between the supporting section and the first terminal.

The switch may further include two of the electrostatic coupling sections, and the first electrodes of the two electrostatic coupling sections may be provided in a direction perpendicular to a longitudinal direction of the moving section on both sides of the first terminal. Width of a part, where the first terminal in the moving section is provided, may be narrower than width of another part.

The moving section may include a plurality of components having different coefficients of thermal expansion from one another. The moving section may include shape memory alloy. The driving means may further include a heater for heating the shape memory alloy. The switch may further include: a substrate on which the second terminal is provided; and a supporting section provided on the substrate for supporting the moving section. The driving means may further include first magnetic material provided at the moving section, and second magnetic material provided at the substrate. The driving means may further include a heater for heating a plurality of components in which the coefficients of thermal expansion are different form one another. The driving means may include a piezoelectric element.

According to the second aspect of the present invention, there is provided a switch for connecting a first terminal with a second terminal electrically. The switch includes: the first terminal; the second terminal confronting the first terminal; driving means for driving the first terminal in the direction opposite to the second terminal; and an electrostatic coupling section including a first electrode and a second electrode confronting each other for attracting the first terminal in the direction of the second terminal by electrostatic force.

According to the third aspect of the present invention, there is provided an integrated circuit device in which a plurality of switches for connecting a first terminal with a second terminal electrically are provided on a substrate. The switches of the integrated circuit device includes: a first terminal; a second terminal confronting the first terminal; driving means for driving the first terminal in the direction of the second terminal; and an electrostatic coupling section including a first electrode and a second electrode confronting each other for attracting the first terminal in the direction of the second terminal by electrostatic force.

According to the fourth aspect of the present invention, there is provided a manufacturing method of a switch for connecting a first terminal with a second terminal electrically. The method includes steps of: forming switch section on a first substrate, the switch section including the first terminal electrically connecting with the second terminal by contacting the second terminal, a moving section which holds the first terminal and is driven in the direction of the second terminal by supply of electric power, and a first electrode provided on the moving section; forming a support on a second substrate, the support including a second terminal, a second electrode, and a supporting section for supporting the switch section; and bonding the first substrate and the second substrate so that the first terminal confronts the second terminal and the first electrode confronts the second electrode.

The switch formation step may include a step for forming a plurality of components, of which coefficients of thermal expansion are different from one another, in the moving section.

The summary of the invention does not necessarily describe all necessary features of the present invention. The present invention may also be a sub-combination of the features described above.

DETAILED DESCRIPTION OF THE INVENTION

Embodiments of the present invention will now be described by way of example with reference to the accompanying drawings.

First Embodiment

Figure 1A:
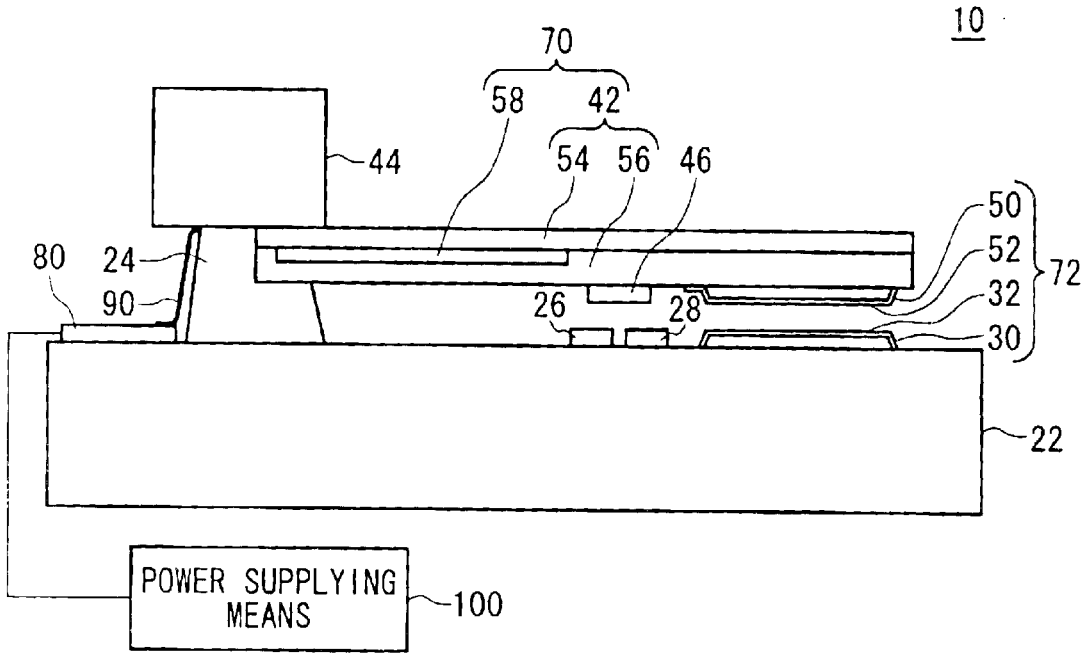
FIGS. 1A and 1B are cross sectional views of a switch according to a first embodiment of the present invention.
Figure 1B:
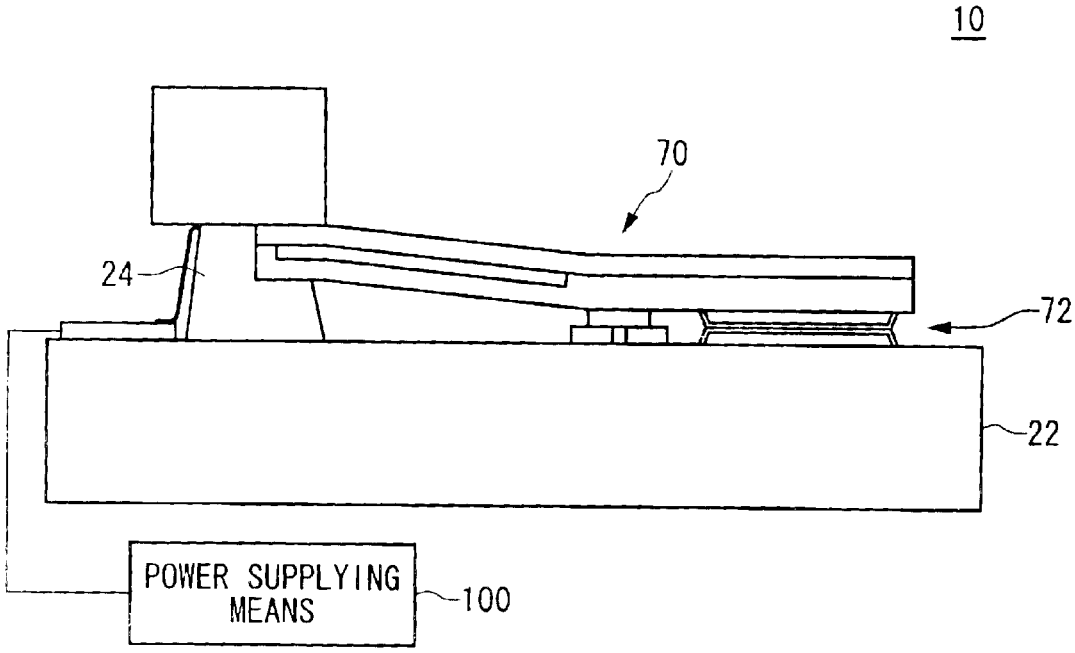

FIGS. 1A and 1B is cross sectional views exemplary showing a switch 10 according to a first embodiment of the present invention. FIG. 1A is a cross sectional view of the switch 10 being open. FIG. 1B is a cross sectional view of the switch 10 being closed.

The switch 10 includes a first terminal 46, a second terminal 26 and the third terminal 28 confronting the first terminal 46, driving means 70 for driving the first terminal 46 in the direction of the second terminal 26 and the third terminal 28, and an electrostatic coupling section 72 including a first electrode 50 and a second electrode 30 confronting each other for attracting the first terminal 46 in the direction of the second terminal 26 and the third terminal 28 by electrostatic force. The driving means 70 includes a moving section 42 which holds the first terminal 46 and is driven in the direction of the second terminal 26 and the third terminal 28.

Moreover, the switch 10 is provided on a substrate 22 and above the substrate 22, and further includes a supporting section 24 for supporting the moving section 42, a supported section 44 for fixing the moving section 42 to the supporting section 24, electric power supplying means 100 for supplying electric power to at least either the driving means 70 or the electrostatic coupling section 72, and a lead wire section 80 and a connection wiring 90 for connecting the driving means 70 and the electrostatic coupling section 72 with the electric power supplying means 100.

The second terminal 26, the third terminal 28, the second electrode 30, and the lead wire section 80 are formed on the substrate 22. The moving section 42 holds the first terminal 46 so that it confronts the second terminal 26 and the third terminal 28, and holds the first electrode 50 so that it confronts the second electrode 30.

It is preferable that the moving section 42 includes a plurality of components having different coefficients of thermal expansion. The plurality of components having different coefficients of thermal expansion may be a plurality of metals of which the coefficients of thermal expansion are different from one another. Since the moving section 42 includes the plurality of components in layers, of which the coefficients of thermal expansion are different from one another, the shape is deformed due to the differences of the coefficients of thermal expansion of the components when the components are heated. When not being driven in the direction of the second terminal 26 and the third terminal 28, the moving section 42 is provided being curved in an opposite direction to the second terminal 26 and the third terminal 28 so that the first terminal 46 does not contact the second terminal 26 and the third terminal 28.

It is desirable that the driving means 70 includes means for driving the first terminal 46 in the direction of the second terminal 26 and the third terminal 28, by supplying electric power. Moreover, it is desirable that the driving means 70 includes means for heating the moving section 42 including the plurality of components having different thermal conductivities.

In the present embodiment, the driving means 70 includes a first component 54, a second component 56, and a heater 58 for heating the first component 54 and the second component 56. It is desirable that the first component 54 is made of material having higher coefficient of thermal expansion than the material of which the second component 56 is made. It is preferable that the first component 54 is made of material having comparatively high coefficient of thermal expansion, such as aluminum, nickel, nickel-iron, palladium-copper-silicon, or resin. It is preferable that the second component is made of material having comparatively low coefficient of thermal expansion, such as silicon oxide, silicon, silicon nitride, or aluminum oxide.

The heater 58 heats the first component 54 and the second component 56. It is preferable that the heater 58 is provided at a part being different from a part at which the first terminal 46 of the moving section 42 is provided. It is preferable that the heater 58 is made of material which generates heat by supplying electric current. Moreover, it is preferable that the heater 58 is made of material of which the coefficient of thermal expansion is higher than the material of the second component 56, and is lower than the material of the first component 54. In the present embodiment, the heater 58 is made of metal resistors, such as nickel-chrome alloy or metallic laminated film of chromium and platinum.

In another example, the driving means 70 includes infrared irradiating means provided, for example, outside the moving section 42. In this case, the driving means 70 heats the moving section 42 by the infrared irradiating means. Moreover, in another example, the driving means 70 includes a temperature controllable chamber. In this case, the driving means 70 heats the moving section 42 by controlling the temperature of the chamber.

The driving means 70 further includes a component made of material, of which the coefficient of thermal expansion is different from the first component 54 and the second component 56, being provided between the first component 54 and the second component 56 so as to control the amount of drives of the moving section 42.

In case that the first component 54 or the second component 56 is made of conductive material, it is preferable that the moving section 42 further includes an insulating member for insulating the first component 54 and the second component 56, and the heater 58. For example, the insulating member is insulating material, such as silicon oxide.

It is preferable that the electrostatic coupling section 72 includes an insulating layer on at least either surface of the first electrode 50 and the second electrode 30. In the present embodiment, the first electrode 50 and the second electrode 30 include a first insulating layer 52 and a second insulating layer 32 respectively. The first insulating layer 52 and the second insulating layer 32 are made of a silicon-oxide layer or the like. It is preferable that the first electrode 50 and the second electrode 30 are made of metal having high conductivity, such as platinum or gold. Alternatively, the first electrode 50 includes an adhesion layer, such as titanium, between the moving section 42 and the first electrode 50, and the second electrode 30 includes an adhesion layer, such as titanium, between the substrate 22 and the second electrode 30.

In process of the first terminal 46 being attracted in the direction of the second terminal 26 and the third terminal 28 by the electrostatic coupling section 72, it is preferable that the supporting section 24 supports the moving section 42 so that the first terminal 46 connects with the second terminal 26 and the third terminal 28. The supporting section 24 may be integrated with the substrate 22 by manufacturing the substrate 22. The supported section 44 may be integrated with the moving section 42 by manufacturing a substrate from which the moving section 42 is formed.

In the present embodiment, it is preferable that the first terminal 46 is provided between the supporting section 24 and the first electrode 50. It is preferable that the first terminal 46, the second terminal 26, and the third terminal 28 are made of metal having high conductivity, such as for example, platinum or gold. Alternatively, the first terminal 46 includes an adhesion layer, such as titanium, between the moving section 42 and the first terminal 46, and the second terminal 26 and the third terminal 28 include an adhesion layer, such as titanium, between the substrate 22 and the second terminal 26 and the third terminal 28. Thereby, adhesion between the first terminal 46 and the moving section 42, adhesion between the second and third terminals 26, 28 and the substrate 22 are improved.

Moreover, in case that the second component 56 of the moving section 42 is made of conductive material, it is preferable that the moving section 42 further includes an insulating member for insulating the second component 56 and the first terminal 46. The insulating member is insulating material, such as silicon oxide.

In the present embodiment, the driving means 70 drives the moving section 42, and causes the first terminal 46 to contact the second terminal 26 and the third terminal 28. Therefore, the moving section 42 causes the second terminal 26 and the third terminal 28 to connect with each other electrically.

Figure 2A:
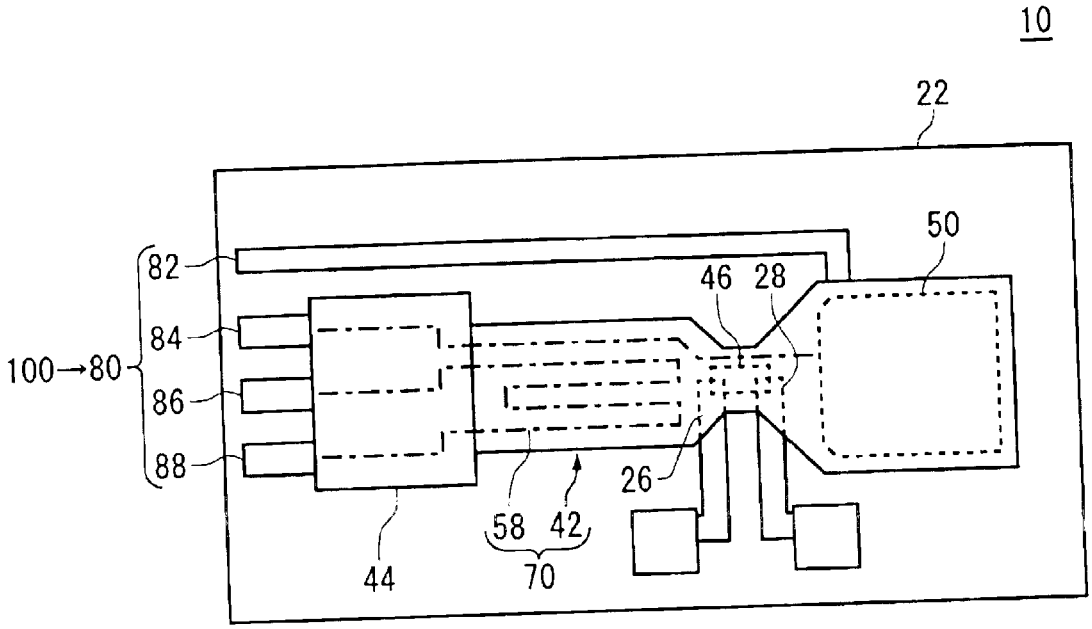
FIGS. 2A and 2B are top views of the switch shown in FIGS. 1A and 1B.
Figure 2B:
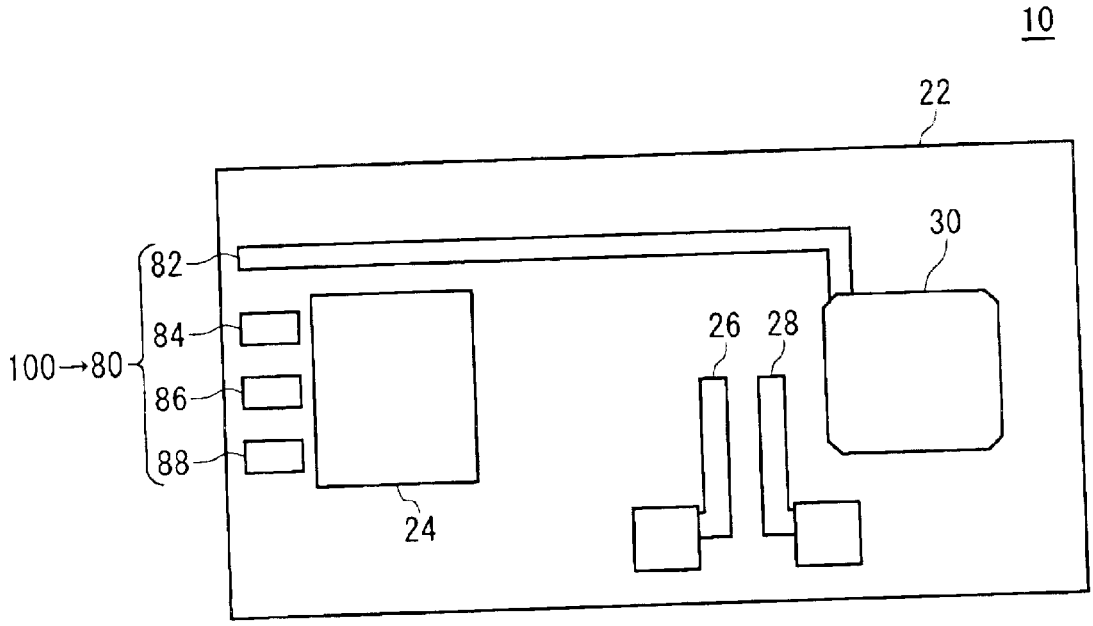

FIGS. 2A and 2B are top views of the switch 10 shown in FIGS. 1A and 1B. FIG. 2A is a top view of the switch 10 with which the moving section 42 is provided above the substrate 22. FIG. 2B is a top view of the substrate 22.

The switch 10 includes the substrate 22, the drive section 70, the lead wire section 80, and the electric power supply means 100. The lead wire section 80 includes a lead wire 82 for the second electrode and a lead wire 84 for first electrode, and a first lead wire 86 for the heater and a second lead wire 88 for the heater. The lead wire 82 for the second electrode connects with the second electrode 30 to supply voltage to the second electrode 30. The lead wire 84 for the first electrode connects with the first electrode 50 to supply voltage to the first electrode 50. The first lead wire 86 for the heater and the second lead wire 88 for the heater connect with the heater 58 to supply electric current to the heater 58. The electric power supply means 100 controls the electric power supplied to the lead wire 84 for the first electrode and the lead wire 82 for the second electrode, and the first lead wire 86 for the heater and the second lead wire 88 for the heater.

It is preferable that the width of a part where the first terminal 46 in the moving section 42 is narrower than the width of another part. Thereby, the moving section 42 connects the first terminal 46 with the second terminal 26 and the third terminal 28 easily.

Next, with reference to FIGS. 1A, 1B, 2A and 2B, operation of the switch 10 according to the present embodiment will be explained. As shown in FIG. 1A, the supporting section 24 supports the moving section 42 so that the first terminal 46 keeps a predetermined distance to the second terminal 26 and the third terminal 28. Here, a signal is supplied to the second terminal 26.

When the switch 10 is going to be closed, the electric power supply means 100 supplies current to the heater 58 of the driving means 70 through the first lead wire 86 for the heater and the second lead wire 88 for the heater. Then, the first component 54 and the second component 56 are heated by the heater 58. Since the coefficients of thermal expansion of the first component 54 and the second component 56 are different from each other, the first component 54 expands more than the second component 56 by heating them. Consequently, as shown in FIG. 1B, the moving section 42 is driven in the direction of the substrate 22. Then, by the first terminal 46 provided on the moving section 42 contacting the second terminal 26 and the third terminal 28, the second terminal 26 and the third terminal 28 are electrically connected. Therefore, the signal supplied to the second terminal 26 is supplied to the third terminal 28 through the first terminal 46.

When the moving section 42 is driven in the direction of the substrate 22 and the first terminal 46 contacts the second terminal 26 and the third terminal 28, the electric power supply means 100 supplies voltage to the electrostatic coupling section 72 through the lead wire 84 for the first electrode and the lead wire 82 for the second electrode. Alternatively, when the moving section 42 is driven in the direction of the substrate 22, and a part where the first electrode 50 of the moving section 42 is provided approaches a part where the second electrode 30 of the substrate 22 is provided so that they are under the influence of the electrostatic attraction, the electric power supply means 100 supplies voltage to the electrostatic coupling section 72 through the lead wire 84 for the first electrode and the lead wire 82 for the second electrode. By supplying voltage to the electrostatic coupling section 72, electrostatic force occurs between the first electrode 50 and the second electrode 30 of the electrostatic coupling section 72. The electrostatic coupling section 72 attracts the moving section 42 in the direction of the substrate 22 by the electrostatic force between the first electrode 50 and the second electrode 30. Alternatively, the electric power supply means 100 stops the current having been supplied to the driving means 70 while supplying voltage to the electrostatic coupling section 72.

When the switch 10 is going to be opened, the electric power supply means 100 stops the voltage having been supplied to the electrostatic coupling section 72. Thereby, the electrostatic force between the first electrode 50 and the second electrode 30 of the electrostatic coupling section 72 disappears. Therefore, the moving section 42 moves in the direction opposite to the substrate 22. Consequently, the first terminal 46 separates from the second terminal 26 and the third terminal 28, and the signal having been supplied to the second terminal 26 is no longer supplied to the third terminal 28.

As described above, since the switch 10 according to the present embodiment keeps the switch being closed by electrostatic force using the plurality of components, of which the coefficients of thermal expansion are different, and the heater for heating the components, as driving force to keep the switch being closed, electric power consumption of the switch is reduced extremely.

Moreover, since the switch 10 according to the present embodiment uses the driving means 70 in order to close the switch, driver voltage of the switch is reduced compared with the switch which is opened and closed by electrostatic force only. Furthermore, since the switch 10 according to the present embodiment uses driving means 70 in order to close the switch, electrode area of the electrostatic coupling section 72 is reduced, and consequently the switch is miniaturized and highly integrated.

Second Embodiment

Figure 3A:
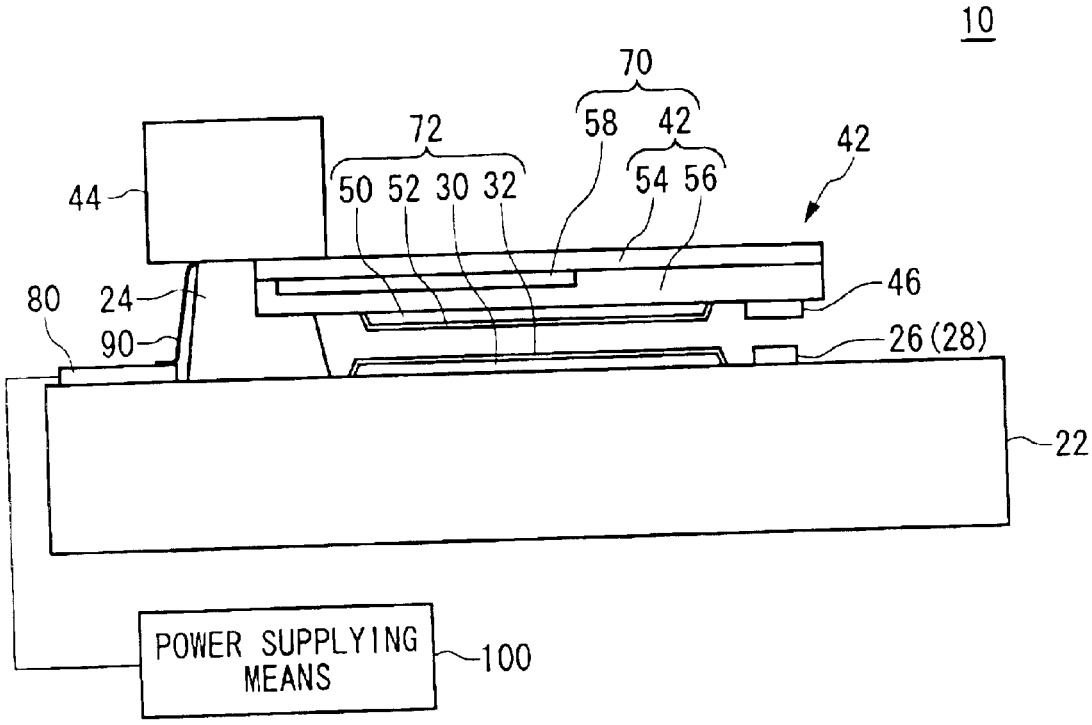
FIGS. 3A and 3B are cross sectional views of the switch according to a second embodiment of the present invention.
Figure 3B:
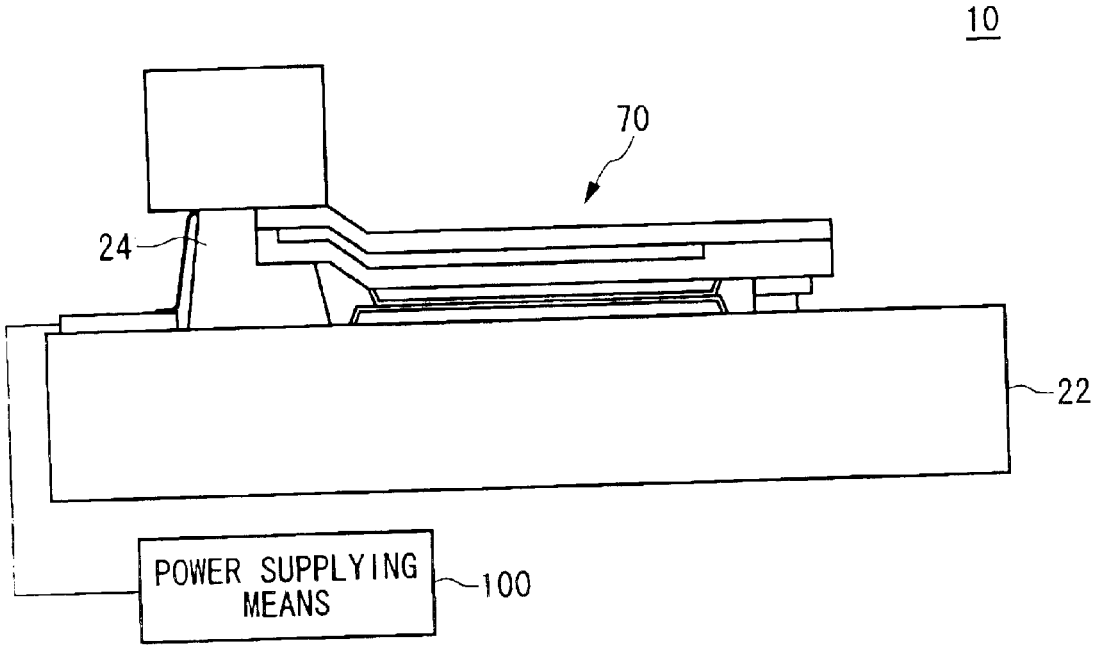

FIGS. 3A and 3B are cross sectional views exemplary showing the switch 10 according to a second embodiment of the present invention. FIG. 3A is a cross sectional view of the switch 10 being open. FIG. 3B is a cross sectional view of the switch 10 being closed.

In the present embodiment, a component similar to the component of the switch 10 of the first embodiment bears the same reference numeral as the switch 10 of the first embodiment shown in FIGS. 1A, 1B, 2A and 2B. Moreover, in the present embodiment, explanation of the configuration and operation similar to the first embodiment will be partially omitted, and different configuration and different operation from the first embodiment will be explained in particular. In the present embodiment, the first electrode 50 is provided between the supporting section 24 and the first terminal 46. It is preferable that the heater 58 is provided at a part being different from a part at which the first terminal 46 of the moving section 42 is provided.

Figure 4A:
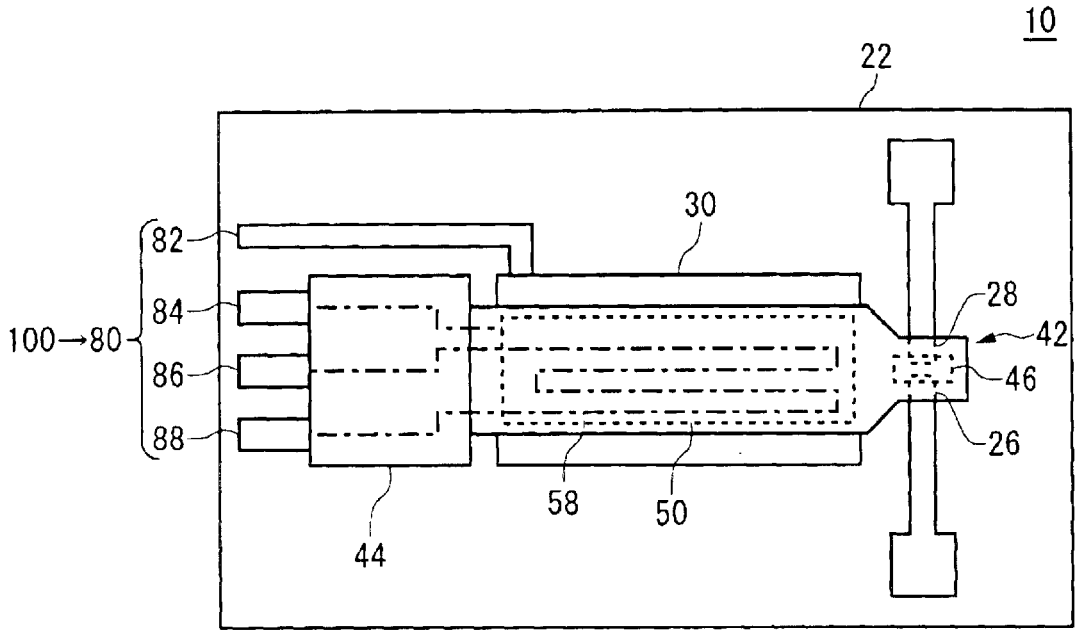
FIGS. 4A and 4B are top views of the switch shown in FIG. 3.
Figure 4B:
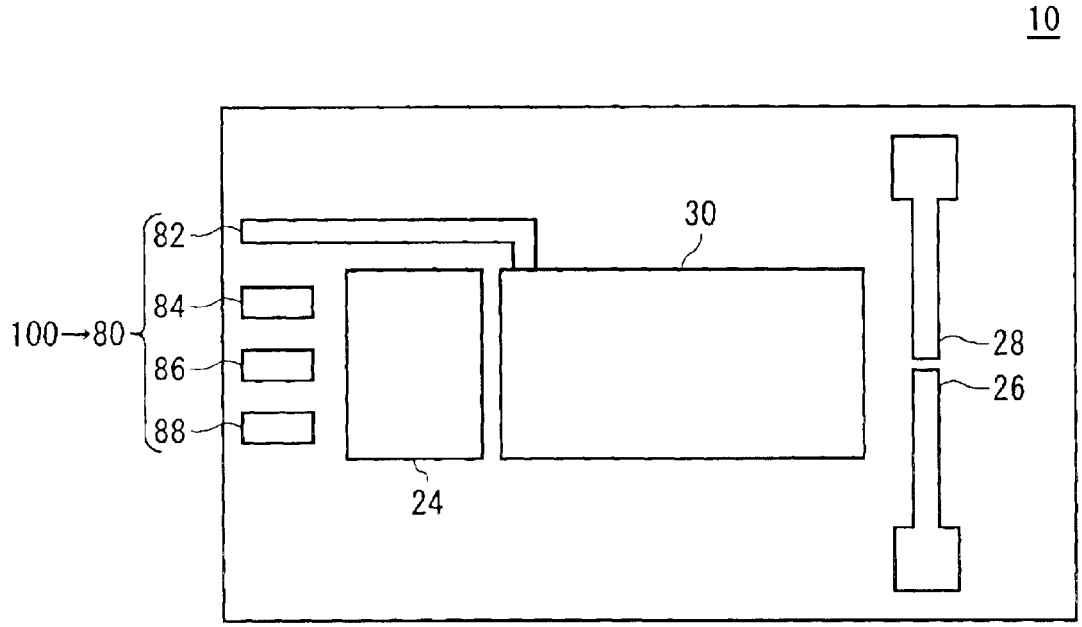

FIGS. 4A and 4B are top views of the switch 10 shown in FIGS. 3A and 3B. FIG. 4A is a top view of the switch 10 with which the moving section 42 is provided above the substrate 22. FIG. 4B is a top view of the substrate 22.

It is preferable that the width of a part where the first terminal 46 in the moving section 42 is narrower than the width of another part. Thereby, the moving section 42 connects the first terminal 46 with the second terminal 26 and the third terminal 28 easily.

In the present embodiment, as shown in FIGS. 3A, 3B, 4A and 4B, since the first electrode 50 is provided at an edge of the moving section 42, the heater 58 having large surface area is provided on the moving section 42. Therefore, driving force of the driving means 70 is magnified. Furthermore, since the switch 10 according to the present embodiment uses driving means 70 in order to close the switch, electrode area of the electrostatic coupling section 72 is reduced, and consequently the switch is miniaturized and highly integrated.

Third Embodiment

Figure 5:
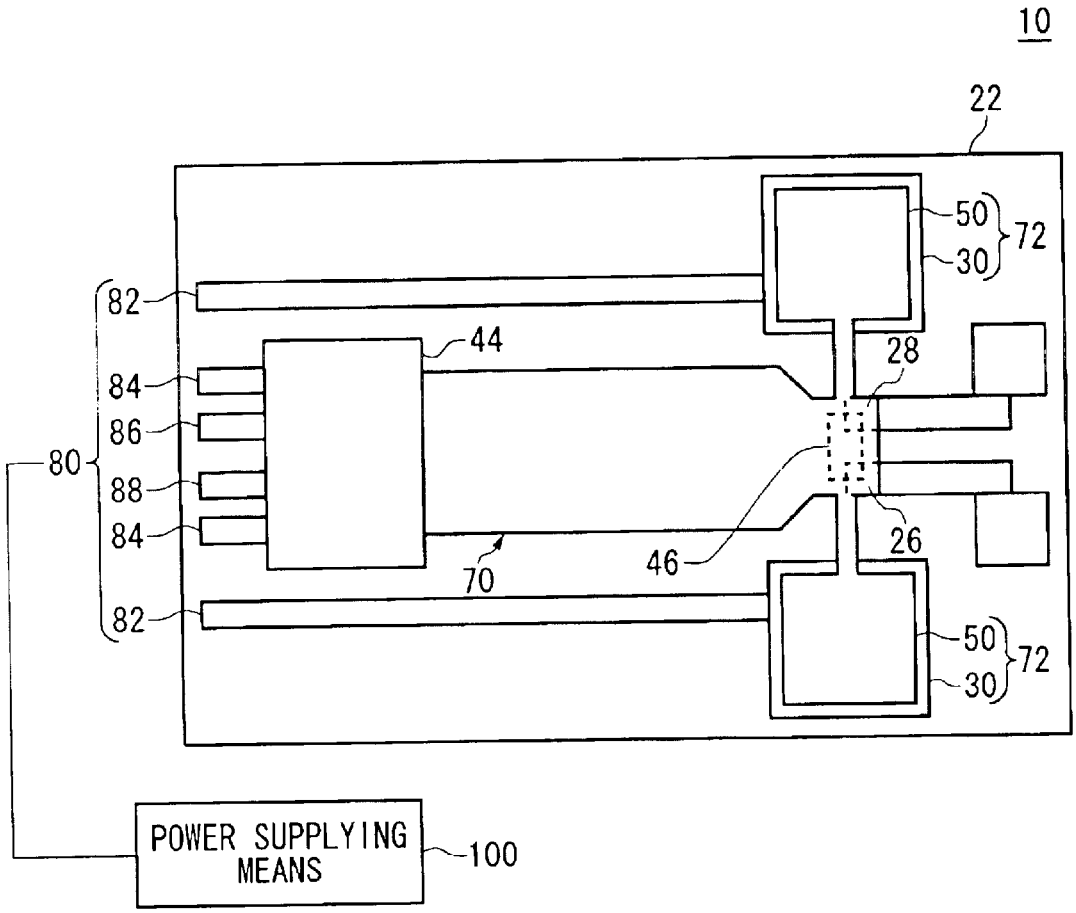
FIG. 5 is a top view of the switch according to a third embodiment of the present invention.

FIG. 5 is a top view exemplary showing the switch 10 according to a third embodiment of the present invention. A component similar to the component of the switch 10 of the first embodiment bears the same reference numeral as the switch 10 of the first embodiment shown in FIGS. 1A, 1B, 2A and 2B. Moreover, in the present embodiment, explanation of the configuration and operation similar to the first embodiment will be partially omitted, and different configuration and different operation from the first embodiment will be explained in particular.

In the present embodiment, the switch 10 includes two electrostatic coupling sections 72. Each of the electrostatic coupling section 72 includes the first electrode 50 and the second electrode 30. It is preferable that each of the electrostatic coupling section 72 includes an insulating layer on at least either surface of the first electrode 50 and the second electrode 30. In the present embodiment, the first electrodes 50 of the two electrostatic coupling sections 72 lie in lines perpendicular to the longitudinal direction of the moving section 42 across the first terminal 28. In the present embodiment, since the switch 10 includes the two electrostatic coupling sections 72, electrostatic force of the electrostatic coupling sections 72 is magnified.

Fourth Embodiment

Figure 6:
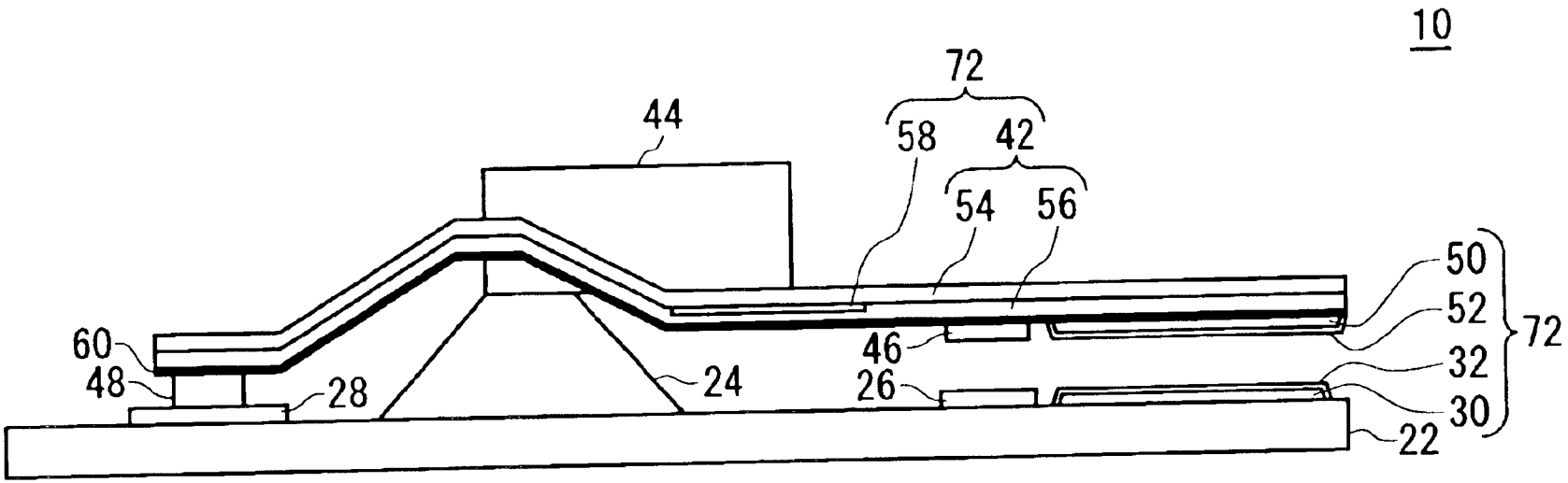
FIG. 6 is a cross sectional view of the switch according to a fourth embodiment of the present invention.

FIG. 6 is a cross sectional view exemplary showing the switch 10 according to a fourth embodiment of the present invention. A component similar to the component of the switch 10 of the first embodiment bears the same reference numeral as the switch 10 of the first embodiment shown in FIGS. 1A, 1B, 2A and 2B. Moreover, in the present embodiment, explanation of the configuration and operation similar to the first embodiment will be partially omitted, and different configuration and different operation from the first embodiment will be explained in particular.

In the present embodiment, the switch 10 includes the first terminal 46, the second terminal 26 confronting the first terminal 46, the driving means 70 for driving the first terminal 46 in the direction of the second terminal 26, and the electrostatic coupling section 72 including the first electrode 50 and the second electrode 30, which confront each other, for attracting the first terminal 46 in the direction of the second terminal 26 by electrostatic force. The driving means 70 includes the moving section 42 which holds the first terminal 46 and is driven in the direction of the second terminal 26 and the third terminal 28.

Moreover, the switch 10 is provided on the substrate 22 and above the substrate 22, and further includes the supporting section 24 for supporting the moving section 42, a wiring 60 provided on the moving section 42, where one end of the wiring 60 connects with the first terminal 46, the supported section 44 for fixing the moving section 42 to the supporting section 24, and the third terminal 28 connecting with another end of the wiring 60 and provided on the substrate 22. It is desirable that the switch 10 further includes the electric power supply means for supplying electric power to at least either the driving means 70 or the electrostatic coupling section 72. Moreover, it is desirable that the third terminal 28 connects with the other end of the wiring 60 by a connecting member 48.

The second terminal 26, the third terminal 28, and the second electrode 30 are formed on the substrate 22. The moving section 42 holds the first terminal 46 so that it confronts the second terminal 26, and holds the first electrode 50 so that it confronts the second electrode 30. It is preferable that the supporting section 24 is provided between the second terminal 26 and the third terminal 28.

The connecting member 48 is conductive adhesive material and is preferably made of solder. In the present embodiment, the connecting member 48 is made of solder including, for example, gold-tinalloy, gold-germanium alloy, lead-tin alloy, indium, etc. Alternatively, the connecting member 48 is made of conductive resin, such as for example, silver epoxy resin. Alternatively, the connecting member 48 is provided by forming a bump made of gold or the like. Alternatively, in case that the second component 56 is made of conductive material, the second component 56 functions as the wiring 60.

Next, operation of the switch 10 according to the present embodiment will be explained. The supporting section 24 supports the moving section 42 so that the first terminal 46 keeps a predetermined distance to the second terminal 26. Here, a signal is supplied to the second terminal 26.

When the switch 10 is going to be closed, the electric power supply means supplies current to the heater 58 of the driving means 70. Then, the first component 54 and the second component 56 are heated by the heater 58. Since the coefficients of thermal expansion of the first component 54 and the second component 56 are different from each other, the first component 54 expands more than the second component 56 by heating them. Consequently, the moving section 42 is driven in the direction of the substrate 22. Then, by the first terminal 46 provided on the moving section 42 contacting the second terminal 26, the second terminal 26 and the third terminal 28 are electrically connected through the wiring 60. Therefore, the signal supplied to the second terminal 26 is supplied to the third terminal 28 through the first terminal 46.

When the moving section 42 is driven in the direction of the substrate 22 and the first terminal 46 contacts the second terminal 26, the electric power supply means supplies voltage to the electrostatic coupling section 72. Alternatively, when the moving section 42 is driven in the direction of the substrate 22 and a part where the first electrode 50 of the moving section 42 is provided approaches a part where the second electrode 30 of the substrate 22 is provided so that they are under the influence of the electrostatic attraction, the electric power supply means supplies voltage to the electrostatic coupling section 72. By supplying voltage to the electrostatic coupling section 72, electrostatic force occurs between the first electrode 50 and the second electrode 30 of the electrostatic coupling section 72. The electrostatic coupling section 72 attracts the moving section 42 in the direction of the substrate 22 by the electrostatic force between the first electrode 50 and the second electrode 30. Alternatively, the electric power supply means stops the current having been supplied to the driving means 70 while supplying voltage to the electrostatic coupling section 72.

When the switch 10 is going to be opened, the electric power supply means stops the voltage having been supplied to the electrostatic coupling section 72. Thereby, the electrostatic force between the first electrode 50 and the second electrode 30 of the electrostatic coupling section 72 disappears. Therefore, the moving section 42 moves in the direction opposite to the substrate 22. Consequently, the first terminal 46 separates from the second terminal 26, and the signal having been supplied to the second terminal 26 is no longer supplied to the third terminal 28.

As described above, since the switch 10 according to the present embodiment keeps the switch being closed by electrostatic force using the plurality of components, of which the coefficients of thermal expansion are different, and the heater for heating the components, as driving force to keep the switch being closed, electric power consumption of the switch is reduced extremely.

Moreover, since the switch 10 according to the present embodiment uses the driving means 70 in order to close the switch, driver voltage of the switch is reduced compared with the switch which is opened and closed by electrostatic force only. Furthermore, since the switch 10 according to the present embodiment uses driving means 70 in order to close the switch, electrode area of the electrostatic coupling section 72 is reduced, and consequently the switch is miniaturized and highly integrated.

Fifth Embodiment

Figure 7:
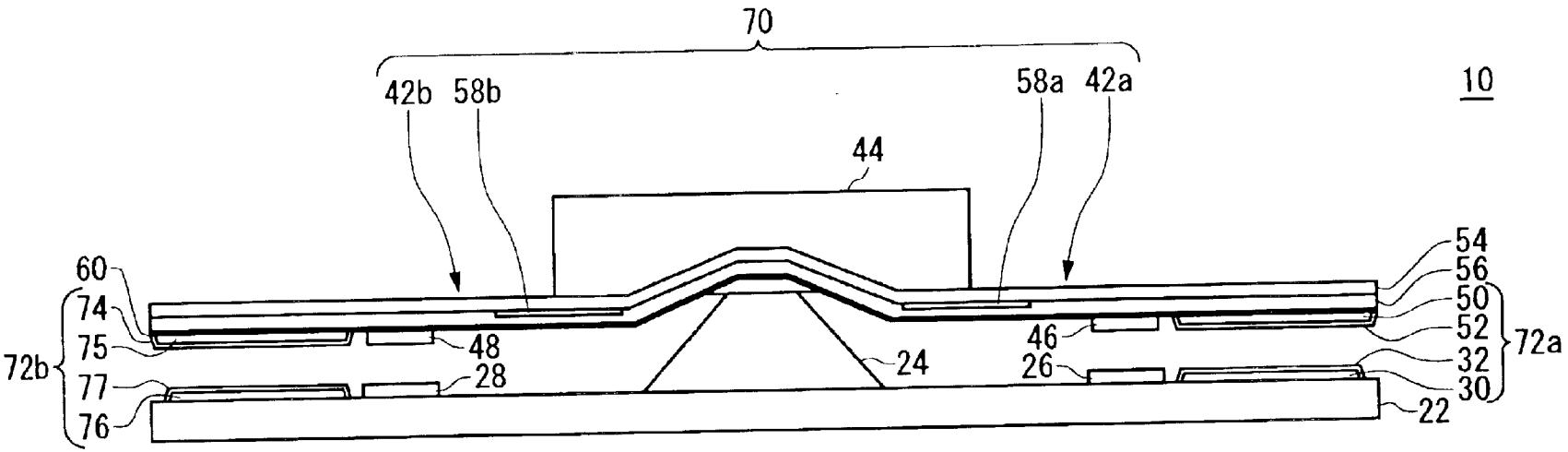
FIG. 7 is a cross sectional view of the switch according to a fifth embodiment of the present invention.

FIG. 7 is a cross sectional view exemplary showing the switch 10 according to the fifth embodiment of the present invention. A component similar to the component of the switch 10 of the first embodiment bears the same reference numeral as the switch 10 of the first embodiment shown in FIGS. 1A, 1B, 2A and 2B. Moreover, in the present embodiment, explanation of the configuration and operation similar to the first embodiment will be partially omitted, and different configuration and different operation from the first embodiment will be explained in particular.

In the present embodiment, the switch 10 includes the first terminal 46, the second terminal 26 confronting the first terminal 46, the wiring 60 of which one end is connected to the first terminal 46, a fourth terminal 48 provided at another end of the wiring 60, the third terminal 28 confronting the fourth terminal 48, the driving means 70 for driving the first terminal 46 in the direction of the second terminal 26 and for driving the fourth terminal 48 in the direction of the third terminal 29, an electrostatic coupling section 72*a* including the first electrode 50 and the second electrode 30, which confront each other, for attracting the first terminal 46 in the direction of the second terminal 26 by electrostatic force, and an electrostatic coupling section 72*b* including a third electrode 74 and a fourth electrode 76, which confront each other, for attracting the fourth terminal 48 in the direction of the third terminal 28 by electrostatic force. The driving means 70 includes a moving section 42*a* which holds the first terminal 46 and is driven in the direction of the second terminal 26, and a moving section 42*b* which holds the fourth terminal 48 and is driven in the direction of the third terminal 28.

Moreover, the switch 10 is provided on the substrate 22 and above the substrate 22, and further includes the supporting section 24 for supporting the moving sections 42*a* and 42*b*, and the supported section 44 for fixing the moving sections 42*a* and 42*b* to the supporting section 24. It is desirable that the switch 10 further includes the electric power supply means for supplying electric power to at least either the driving means 70 or the electrostatic coupling sections 72*a* and 72*b*. In the present embodiment, the driving means 70 includes the first component 54, the second component 56, and the heaters 58*a* and 58*b* for heating the first component 54 and the second component 56.

It is also preferable that the driving means 70 independently controls means for driving the first terminal 46 in the direction of the second terminal 26, and means for driving the fourth terminal 48 in the direction of the third terminal 28.

The second terminal 26, the third terminal 28, the second electrode 30, and the fourth electrode 76 are formed on the substrate 22. The moving section 42*a* holds the first terminal 46 so that it confronts the second terminal 26, and holds the first electrode 50 so that it confronts the second electrode 30. Moreover, the moving section 42*b* holds the fourth terminal 48 so that it confronts the third terminal 28, and holds the third electrode 74 so that it confronts the fourth electrode 76. The supporting section 24 is provided between the first terminal 46 and the fourth terminal 48, and supports the moving sections 42*a* and 42*b*.

It is preferable that the electrostatic coupling section 72*a* includes an insulating layer on at least either surface of the first electrode 50 and the second electrode 30. It is preferable that the electrostatic coupling section 72*b* includes an insulating layer on at least either surface of the third electrode 74 and the fourth electrode 76. In the present embodiment, the first electrode 50 and the second electrode 30 include the first insulating layer 52 and the second insulating layer 32 respectively. The third electrode 74 and the fourth electrode 76 include a third insulating layer 75 and a fourth insulating layer 77 respectively.

Next, operation of the switch 10 according to the present embodiment will be explained. The supporting section 24 supports the moving sections 42*a* and 42*b* so that the first terminal 46 keeps a predetermined distance to the second terminal 26, and the fourth terminal 48 keeps a predetermined distance to the third terminal 28. Here, a signal is supplied to the second terminal 26.

When the switch 10 is going to be closed, the electric power supply means supplies current to the heaters 58*a* and 58*b* of the driving means 70. Then, the first component 54 and the second component 56 are heated by the heaters 58*a* and 58*b*. Since the coefficients of thermal expansion of the first component 54 and the second component 56 are different from each other, the first component 54 expands more than the second component 56 by heating them. Consequently, the moving sections 42*a* and 42*b* are driven in the direction of the substrate 22. Then, by the first terminal 46 provided on the moving section 42*a* contacting the second terminal 26, and by the fourth terminal 48 provided on the moving section 42*b* contacting the third terminal 28, the second terminal 26 and the third terminal 28 are electrically connected through the wiring 60. Therefore, the signal supplied to the second terminal 26 is supplied to the third terminal 28 through the first terminal 46 and the fourth terminal 48.

When the moving sections 42*a* and 42*b* are driven in the direction of the substrate 22 and the first terminal 46 contacts the second terminal 26 and the fourth terminal 48 contacts the third terminal 28, the electric power supply means supplies voltage to the electrostatic coupling sections 72*a* and 72*b*. Alternatively, when the moving sections 42*a* and 42*b* are driven in the direction of the substrate 22, and a part where the first electrode 50 of the moving section 42*a* is provided approaches a part where the second electrode 30 of the substrate 22 is provided so that they are under the influence of the electrostatic attraction, and a part where the third electrode 74 of the moving section 42*b* is provided approaches a part where the fourth electrode 76 of the substrate 22 is provided so that they are under the influence of the electrostatic attraction, the electric power supply means supplies voltage to the electrostatic coupling sections 72*a* and 72*b*. By supplying voltage to the electrostatic coupling sections 72*a* and 72*b*, electrostatic force occurs between the first electrode 50 and the second electrode 30 of the electrostatic coupling section 72*a*, and also between the third electrode 74 and the fourth electrode 76 of the electrostatic coupling section 72*b*. The electrostatic coupling section 72 attracts the moving sections 42*a* and 42*b* in the direction of the substrate 22 by the electrostatic force between the first electrode 50 and the second electrode 30, and between the third electrode 74 and the fourth electrode 76. Alternatively, the electric power supply means stops the current having been supplied to the driving means 70 while supplying voltage to the electrostatic coupling sections 72*a* and 72*b*.

When the switch 10 is going to be opened, the electric power supply means stops the voltage having been supplied to the electrostatic coupling section 72. Thereby, the electrostatic force between the first electrode 50 and the second electrode 30 and between the third electrode 74 and the fourth electrode 76 of the electrostatic coupling section 72 disappears. Therefore, the moving sections 42*a* and 42*b* move in the direction opposite to the substrate 22. Consequently, since the first terminal 46 separates from the second terminal 26 and the fourth terminal 48 separates from the third terminal 28, the signal having been supplied to the second terminal 26 is no longer supplied to the third terminal 28.

As described above, since the switch 10 according to the present embodiment keeps the switch being closed by electrostatic force using the plurality of components, of which the coefficients of thermal expansion are different, and the heater for heating the components, as driving force to keep the switch being closed, electric power consumption of the switch is reduced extremely.

Moreover, since the switch 10 according to the present embodiment uses the driving means 70 in order to close the switch, driver voltage of the switch is reduced compared with the switch which is opened and closed by electrostatic force only. Furthermore, since the switch 10 according to the present embodiment uses driving means 70 in order to close the switch, electrode area of the electrostatic coupling section 72 is reduced, and consequently the switch is miniaturized and highly integrated.

Sixth Embodiment

Figure 8:
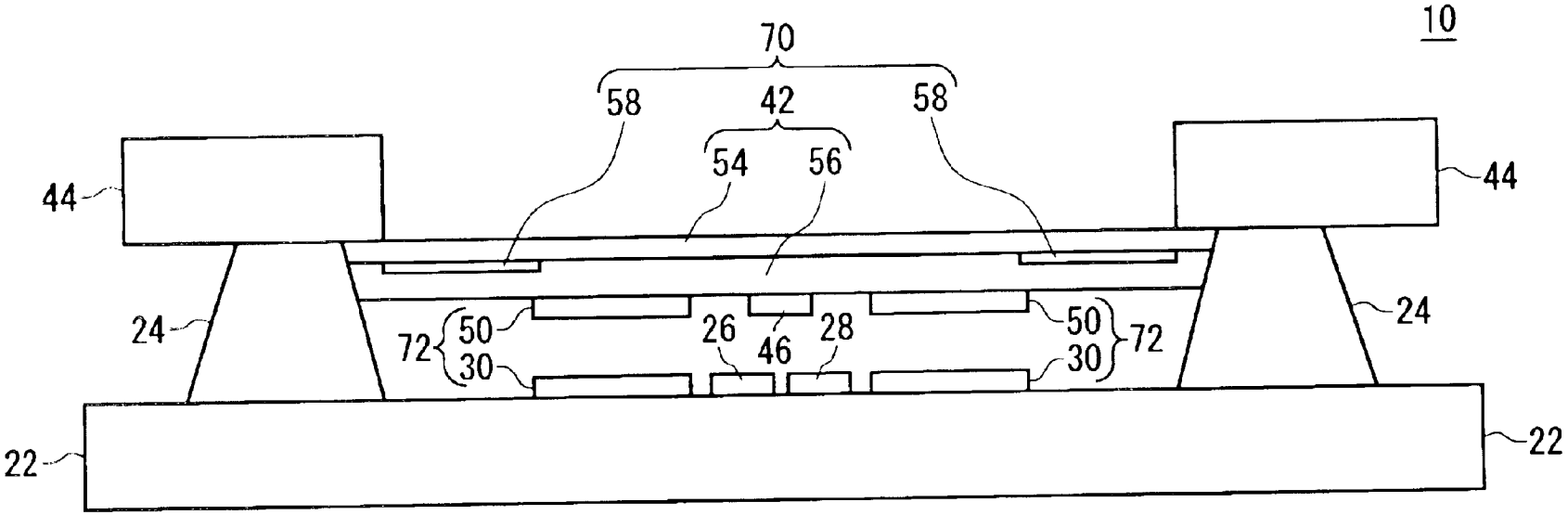
FIG. 8 is a cross sectional view of the switch according to a sixth embodiment of the present invention.

FIG. 8 is a cross sectional view exemplary showing the switch 10 according to a sixth embodiment of the present invention. A component similar to the component of the switch 10 of the first embodiment bears the same reference numeral as the switch 10 of the first embodiment shown in FIGS. 1A, 1B, 2A and 2B. Moreover, in the present embodiment, explanation of the configuration and operation similar to the first embodiment will be partially omitted, and different configuration and different operation from the first embodiment will be explained in particular.

In the present embodiment, the switch 10 has fixed-end-beam structure where the both ends of the moving section 42 are fixed. Alternatively, the switch 10 has structure where three or more ends of the moving section 42 are fixed. In this case, it is preferable that the switch 10 includes combination of the driving means 70 including the plurality of heaters 58 and the plurality of electrostatic coupling sections 72 according to the structure of the switch 10.

Seventh Embodiment

Figure 9:
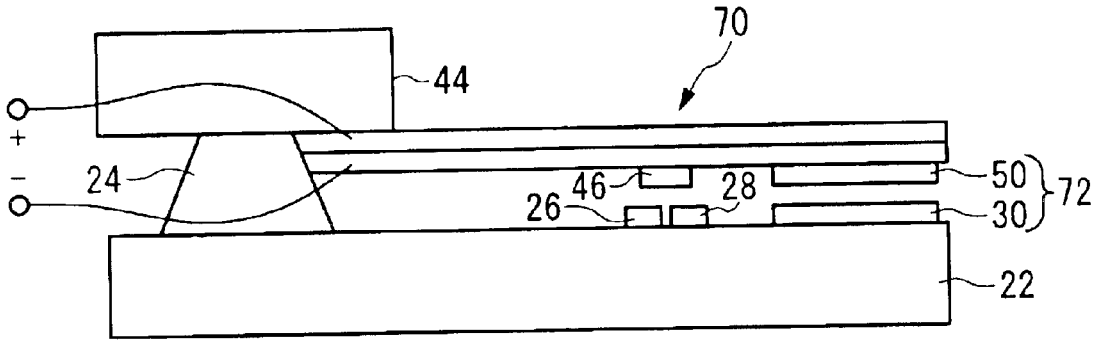
FIG. 9 is a cross sectional view of the switch according to a seventh embodiment of the present invention.

FIG. 9 is a cross sectional view of the switch 10 according to a seventh embodiment of the present invention. A component similar to the component of the switch 10 of the first embodiment bears the same reference numeral as the switch 10 of the first embodiment shown in FIGS. 1A, 1B, 2A and 2B. Moreover, in the present embodiment, explanation of the configuration and operation similar to the first embodiment will be partially omitted, and different configuration and different operation from the first embodiment will be explained in particular.

The driving means 70 of the switch 10 shown in FIG. 9 includes a piezoelectric element. It is preferable that the piezoelectric element is a piezoelectric device made of lead zirconate titanate (PZT) or the like. In the present embodiment, the switch 10 includes the first terminal 46, the second terminal 26 and the third terminal 28 confronting the first terminal 46, the driving means 70 for driving the first terminal 46 in the direction of the second terminal 26 and the third terminal 28, and the electrostatic coupling section 72 including the first electrode 50 and the second electrode 30, which confront each other, for attracting the first terminal 46 in the direction of the second terminal 26 and the third terminal 28 by electrostatic force.

Moreover, the switch 10 is provided on the substrate 22 and above the substrate 22, and further includes the supporting section 24 for supporting the driving means 70, and the supported section 44 for fixing the moving section 42 to the supporting section 24. The driving means 70 includes the piezoelectric element.

Eighth Embodiment

Figure 10:
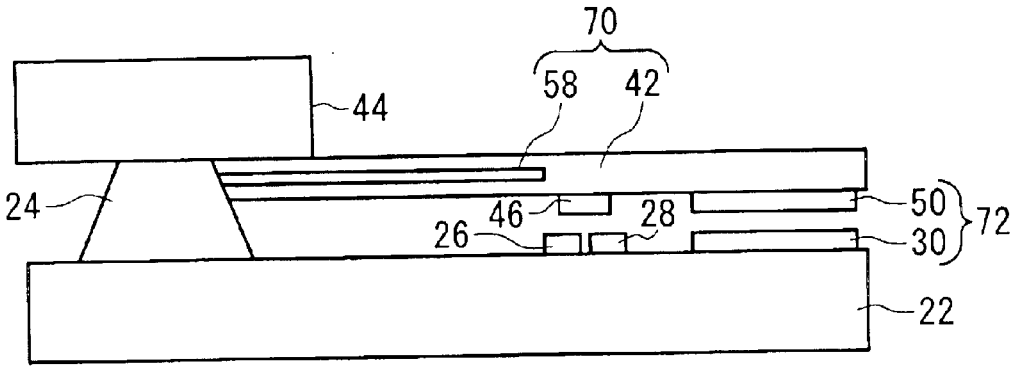
FIG. 10 is a cross sectional view of the switch according to an eighth embodiment of the present invention.

FIG. 10 is a cross sectional view exemplary showing the switch 10 according to an eighth embodiment of the present invention. A component similar to the component of the switch 10 of the first embodiment bears the same reference numeral as the switch 10 of the first embodiment shown in FIGS. 1A, 1B, 2A and 2B. Moreover, in the present embodiment, explanation of the configuration and operation similar to the first embodiment will be partially omitted, and different configuration and different operation from the first embodiment will be explained in particular.

The driving means 70 of the switch 10 shown in FIG. 10 includes shape memory alloy of which the shape is changed according to temperature. In the present embodiment, the switch 10 includes the first terminal 46, the second terminal 26 and the third terminal 28 confronting the first terminal 46, the driving means 70 for driving the first terminal 46 in the direction of the second terminal 26 and the third terminal 28, and the electrostatic coupling section 72 including the first electrode 50 and the second electrode 30, which confront each other, for attracting the first terminal 46 in the direction of the second terminal 26 and the third terminal 28 by electrostatic force. The driving means 70 includes the moving section 42 which holds the first terminal 46 and is driven in the direction of the second terminal 26 and the third terminal 28.

Moreover, the switch 10 is provided on the substrate 22 and above the substrate 22, and further includes the supporting section 24 for supporting the moving section 42, and the supported section 44 for fixing the moving section 42 to the supporting section 24. In the present embodiment, the driving means 70 further includes the heater 58 for heating the shape memory alloy of the moving section 42. The shape memory alloy of the moving section 42 includes titanium-nickel alloy and the like.

Ninth Embodiment

Figure 11:
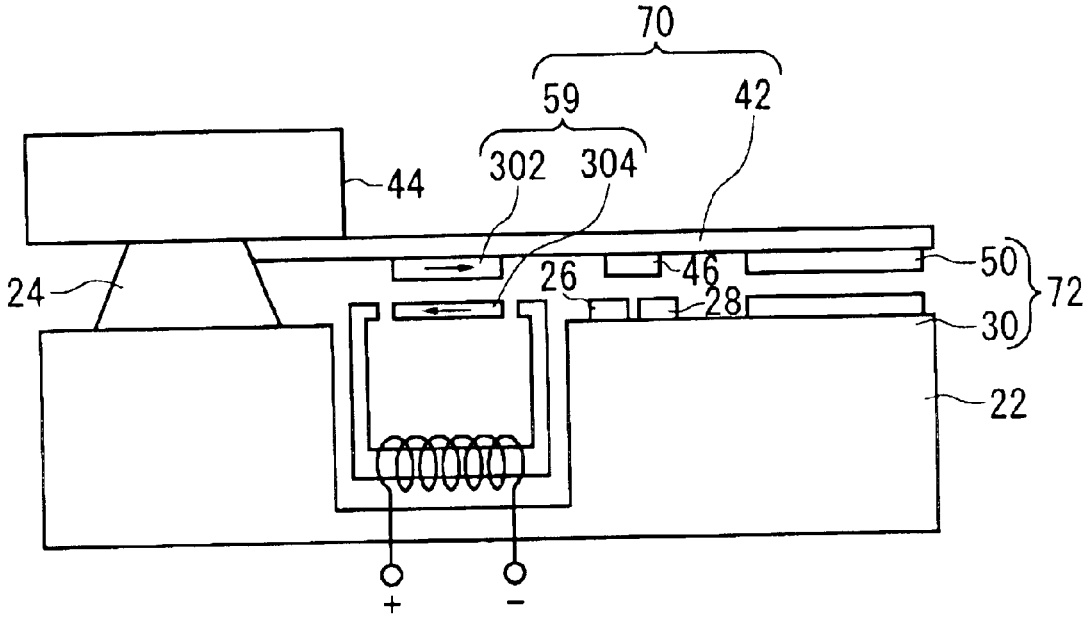
FIG. 11 is a cross sectional view of the switch according to a ninth embodiment of the present invention.

FIG. 11 is a cross sectional view exemplary showing the switch 10 according to an eighth embodiment of a present invention. A component similar to the component of the switch 10 of the first embodiment bears the same reference numeral as the switch 10 of the first embodiment shown in FIGS. 1A, 1B, 2A and 2B. Moreover, in the present embodiment, explanation of the configuration and operation similar to the first embodiment will be partially omitted, and different configuration and different operation from the first embodiment will be explained in particular.

The driving means 70 of the switch 10 shown in FIG. 11 includes magnetic material. In the present embodiment, the switch 10 includes the first terminal 46, the second terminal 26 and the third terminal 28 confronting the first terminal 46, the driving means 70 for driving the first terminal 46 in the direction of the second terminal 26 and the third terminal 28, and the electrostatic coupling section 72 including the first electrode 50 and the second electrode 30, which confront each other, for attracting the first terminal 46 in the direction of the second terminal 26 and the third terminal 28 by electrostatic force. The driving means 70 includes the moving section 42 which holds the first terminal 46 and is driven in the direction of the second terminal 26 and the third terminal 28.

Moreover, the switch 10 is provided on the substrate 22 and above the substrate 22, and further includes the supporting section 24 for supporting the moving section 42, and the supported section 44 for fixing the moving section 42 to the supporting section 24. In the present embodiment, the driving means 70 further includes a magnet section 59 including a first magnetic material 302 provided on the moving section 42 and a second magnetic material 304 provided on the substrate 22. The first magnetic material 302 is a permanent magnet. The second magnetic material 304 includes a coil.

Tenth Embodiment

FIGS. 12A to 12G and FIGS. 13A to 13D are drawings exemplary showing steps of a manufacturing method of the switch 10 according to a tenth embodiment of the present invention. Although an example of the manufacturing method of the switch 10 according to the first embodiment is explained with reference to FIG. 10, it is obvious that the switch 10 according to the other embodiments is manufactured by the same manufacturing method. A component similar to the component of the switch 10 of the first embodiment bears the same reference numeral as the switch 10 of the first embodiment shown in FIGS. 1A, 1B, 2A and 2B.

First, the first terminal 46, the moving section 42 driven in the direction of the second terminal 26 and the third terminal 28 by the electric power supply, and the switch section including the first electrode 50 provided on the moving section 42 are formed on a first substrate 200. Moreover, a support including the second terminal 26, the third terminal 28, the second electrode 30, and the supporting section 24 for supporting the switch section are formed in the second substrate 22. Finally, the switch 10 is manufactured by bonding the first substrate 200 to the second substrate 22 so that the first terminal 46 confronts the second terminal 26 and the third terminal 28 and the first electrode 50 confronts the second electrode 30 respectively.

Figure 12A:
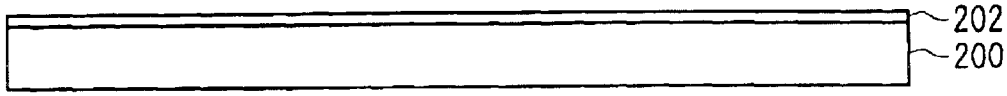
FIG. 12A to FIG. 12G are drawings showing steps of a manufacturing method of the switch according to a tenth embodiment of the present invention.

A step for forming the switch section will be explained with reference to FIGS. 12A to 12G. As shown in FIG. 12A, the first substrate 200 is prepared at first. It is preferable that the first substrate 200 is a single crystal substrate. In the present embodiment, the first substrate 200 is a single-crystal-silicon substrate. Next, the first substrate 200 is oxidized thermally and a silicon oxide film 202 is formed on the first substrate 200. Alternatively, the silicon oxide films 202 are formed on both sides of the first substrate 200.

Figure 12B:
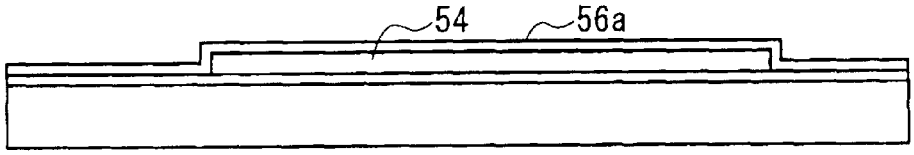

Then, as shown in FIG. 12B, the first component 54 is formed. It is preferable that the first component 54 is made of material having a high coefficient of thermal expansion. Specifically, it is desirable that it is made of material having a higher coefficient of thermal expansion than the second component 56.

In the present embodiment, the first component 54 is formed by following steps. First, material having high coefficient of thermal expansion, such as aluminum, nickel, or nickel-iron alloy, which constitute the first component 54, is deposited by sputtering etc. Then, photoresist is coated on the deposited material and a pattern is formed by exposure and development. Then, the exposed and deposited material is removed by wet etching or dry etching using the photoresist in which the pattern is formed as a mask. Furthermore, the first component 54 is formed only in a desired area where the pattern is formed by removing the photoresist.

In another example, the first component 54 is formed by following steps. First, photoresist is coated and the pattern, which includes an opening in an area where the first component 54 is formed, is formed by exposure and development. Next, material having high coefficient of thermal expansion, such as aluminum, nickel, or nickel-iron alloy is deposited using deposition or sputtering. Then, by removing the photoresist, liftoff, which is a step for removing only the material deposited on the photoresist, is performed, and the first component 54 is formed only in a desired area.

Next, a component 56*a* in the second component 56 (refer to FIG. 1) is formed. It is preferable that the component 56*a* is made of material having low coefficient of thermal expansion. Particularly, it is preferable that the component 56*a* is made of material having lower coefficient of thermal expansion than the first component 54 and also having higher coefficient of thermal expansion than a below-described component 56*b* included in the second component 56. Alternatively, the component 56*a* is made of material having substantially the same coefficient of thermal expansion as the component 56*b*.

In the present embodiment, the component 56*a* makes insulating material, such as silicon oxide, silicon, silicon nitride, and aluminum oxide, deposited by plasma-CVD or sputtering.

Figure 12C:
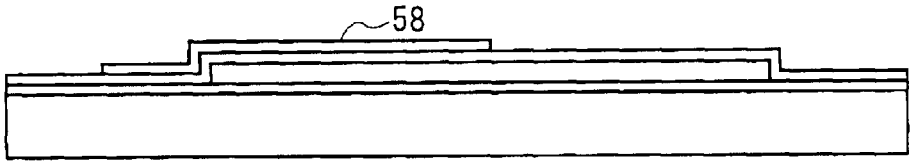

Then, as shown in FIG. 12C, the heater 58 for heating the first component 54 and the second component 56 is formed. It is preferable that the heater 58 is made of material which generates heat by supplying electric current. It is also preferable that the heater 58 is made of material having higher coefficient of thermal expansion than the material of the component 56*b* and also having lower coefficient of thermal expansion than the material of the first component 54.

In the present embodiment, the heater 58 is made of metal resistors, such as nickel-chrome alloy or metallic laminated film of chromium and platinum by the photoresist and the liftoff technology using deposition or sputtering. It is preferable that the material which constitutes the heater 58 is also formed in a part of area on the first substrate 200 where the supporting section 24 is to be bonded in bonding step.

Figure 12D:
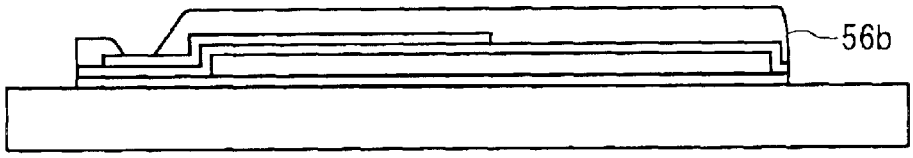

Next, as shown in FIG. 12D, the component 56*b* in the second component 56 is formed. It is preferable that the component 56*b* is made of material having low coefficient of thermal expansion. Specifically, it is preferable that it is made of material having lower coefficient of thermal expansion than the material constituting the first component 54. In the present embodiment, the component 56*b* makes insulating material, such as silicon oxide, silicon, silicon nitride, aluminum oxide, etc., deposited by plasma-CVD or sputtering.

Then, a part of the first substrate 200 is exposed by removing a part of the silicon oxide film 202, the component 56*a*, and the component 56*b*. At this time, in the bonding step, it is preferable that the component 56*b* is formed so that it includes a contact hole from which the heater 58 is exposed in a part of area on the first substrate 200 where the supporting section 24 is to be bonded.

In the present embodiment, photoresist is coated and a desired pattern is formed by exposure and development at first. Next, by removing the silicon oxide film 202, the component 56*a*, and/or the component 56*b* which are made of a silicon oxide film, using hydrofluoric acid solution, the first substrate 200 is exposed and then the contact hole is formed.

Figure 12E:
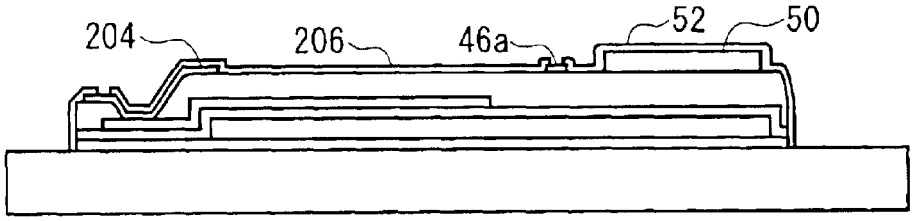

Next, as shown in FIG. 12E, the first electrode 50, a conductive member 46*a* in the first terminal 46, and a connecting member 204 connecting with the heater 58 are formed. It is preferable that the first electrode 50, the conductive member 46*a* in the first terminal 46 and the connecting member 204 are made of metal having high conductivity. In the present embodiment, the first electrode 50, the conductive member 46*a* in the first terminal 46 and the connecting member 204 are made of platinum, gold etc. by liftoff technology using photoresist and metal deposition. Alternatively, in order to improve the adhesion between the first electrode 50, the conductive member 46*a* in the first terminal 46, the connecting member 204, and the component 56*b*, there is provided such as titanium, chromium, or laminated film of titanium and platinum as an adhesion layer between the first electrode 50, the conductive member 46*a* in the first terminal 46, the connecting member 204, and the component 56*b*.

Then, the first insulating layer 52 is formed. In the present embodiment, the first insulating layer 52 makes insulating material, such as silicon oxide, silicon, silicon nitride, and aluminum oxide, deposited using plasma-CVD or sputtering. At this time, an insulating layer 206 is also formed on the conductive member 46*a* and the connecting member 204. It is preferable that the insulating layer 206 is formed so that a part of the conductive member 46*a* and the connecting member 204 is exposed.

Figure 12F:
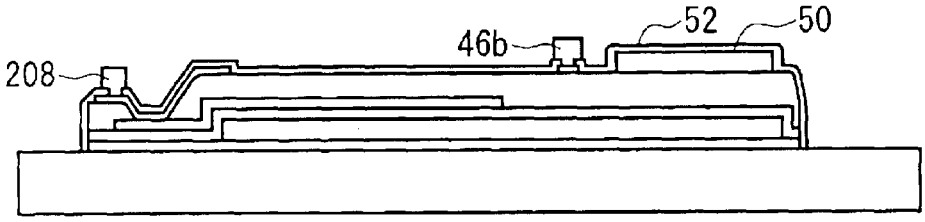

Next, as shown in FIG. 12F, a conductive member 46*b* in the first terminal 46 and a component 208 connecting with the connecting member 204 are formed. It is preferable that the conductive member 46*b* and the component 208 are made of metal having high conductivity, such as for example, platinum or gold.

Figure 12G:
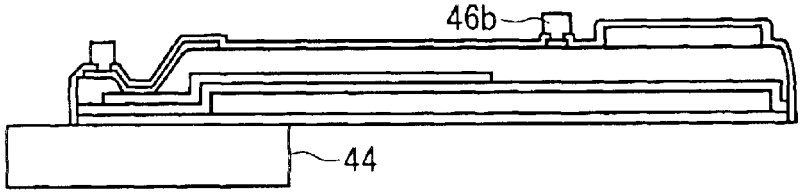

Next, as shown in FIG. 12G, a part of first substrate 200 is removed to form the supported section 44. A pattern corresponding to the supported section 44 is formed on the first substrate 200 using photoresist etc., and it is removed by wet etching or dry etching using hydrofluoric acid solution etc.

Furthermore, the first substrate 200 is thinned by scraping the back side of the surface on which the first terminal 46 of the first substrate 200 etc. is formed.

Figure 13A:
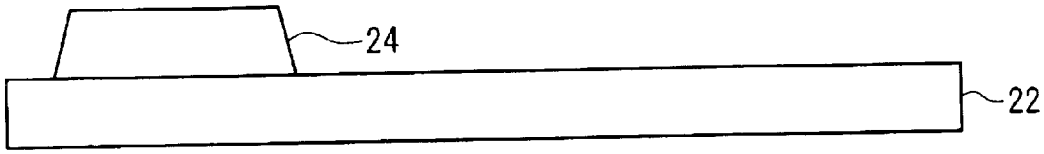
FIG. 13A to FIG. 13D are drawings showing steps of the manufacturing method of the switch according to the tenth embodiment of the present invention.
Figure 13B:
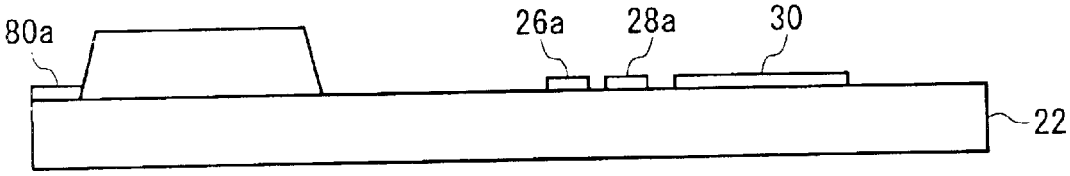

Then, as shown in FIG. 13B, the second electrode 30, a conductive member 26*a* on the second terminal 26, a conductive member 28*a* on the third terminal 28, and a conductive member 80*a* on the lead wire section 80 are formed. It is preferable that the second electrode 30, the conductive member 26*a*, the conductive member 28*a*, and the lead wire section 80 are made of metal having high conductivity. In the present embodiment, the second electrode 30, the conductive member 26*a*, the conductive member 28*a*, and the conductive member 80*a* are made of platinum, gold etc. using the liftoff technology by photoresist and metal deposition. Alternatively, in order to improve the adhesion between the second substrate 22, and the second electrode 30, the conductive member 26*a*, the conductive member 28*a*, the conductive member 80*a*, there is provided such as titanium, chromium, or laminated film of titanium and platinum as an adhesion layer between the second substrate 22, and the second electrode 30, the conductive member 26*a*, the conductive member 28*a*, the conductive member 80*a*.

Figure 13C:
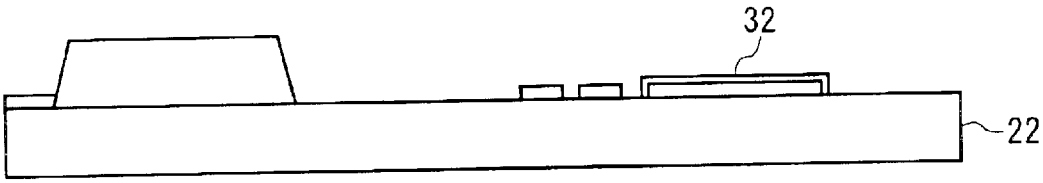

Next, as shown in FIG. 13C, the second insulating layer 32 is formed. In the present embodiment, the second insulating layer 52 makes insulating material, such as silicon oxide, silicon, silicon nitride, and aluminum oxide, deposited using plasma-CVD or sputtering.

Figure 13D:
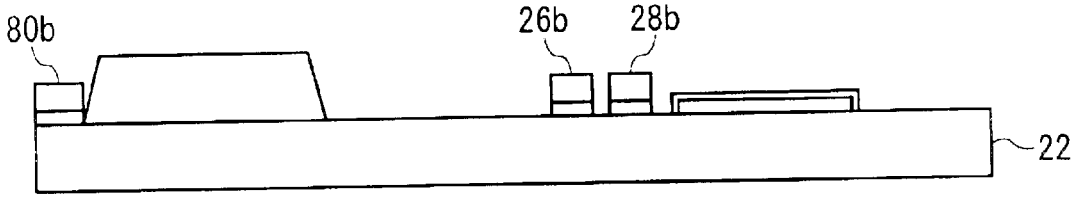

Next, as shown in FIG. 13D, a conductive member 26*b* on the second terminal 26, a conductive member 28*b* on the third terminal 28, and a conductive member 80*b* on the lead wire section 80 are formed. It is preferable that the conductive member 46*b* and the component 208 are made of metal having high conductivity, such as for example, platinum or gold.

Then, the first substrate 200 and the second substrate 22 shown in FIG. 10 are bonded so that the first terminal 46 confronts the second terminal 26 and the third terminal 28, and the first electrode 50 confronts the second electrode 30.

In the present embodiment, it is preferable that a plurality of switch sections are formed on the first substrate 200, and a plurality of supports are formed on the second substrate. In this case, it is preferable that the first substrate 200 and the second substrate 22 are cut to manufacture each of the switches 10 after bonding the first substrate 200 and the second substrate 22.

As described above, since the switch according to the present embodiment closes the switch using the driving means 70 and keeps the switch closed using electrostatic force, the electric power consumption of the switch is reduced extremely.

Eleventh Embodiment

Figure 14:
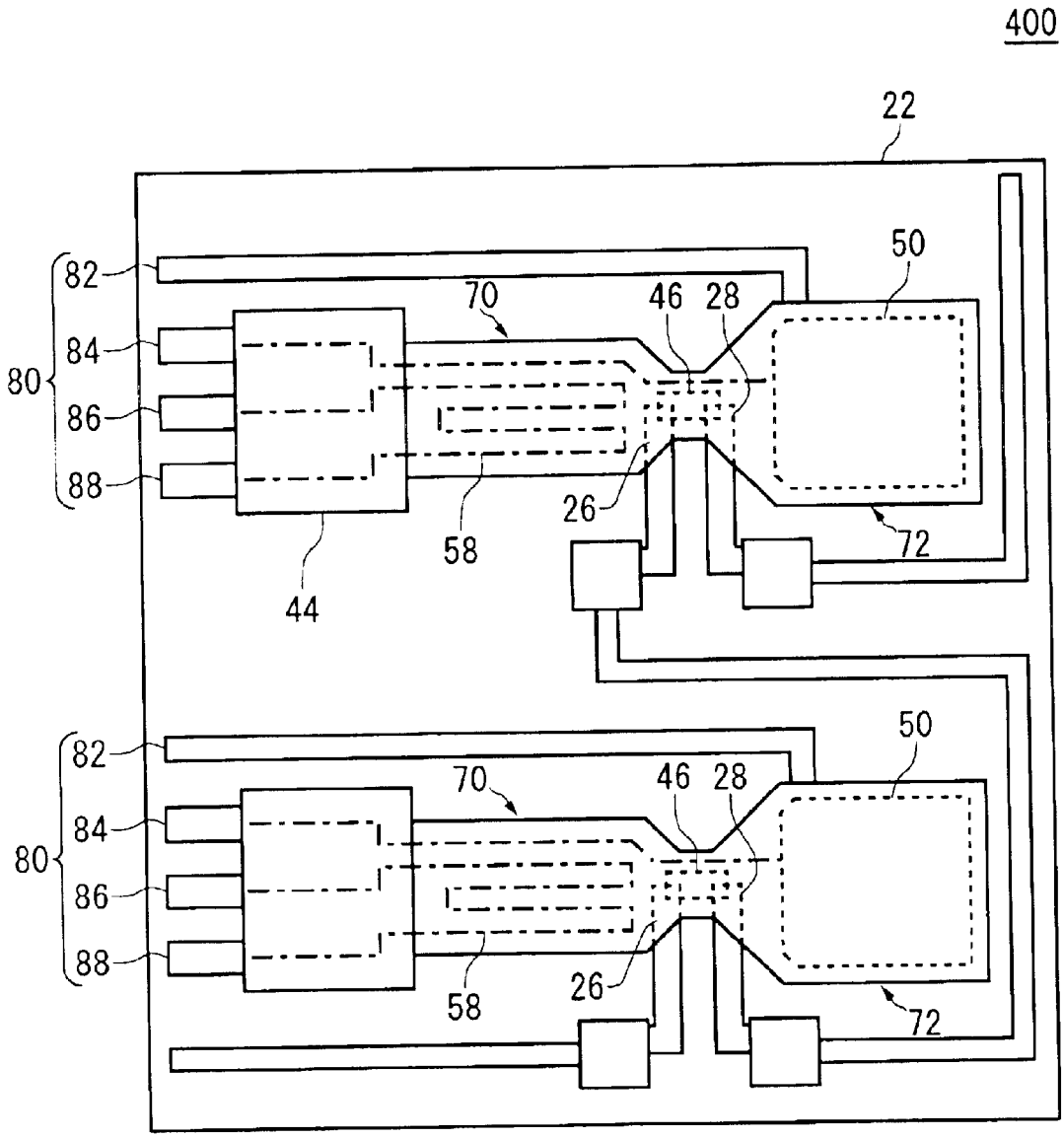
FIG. 14 is a drawing showing an integrated switch according to an eleventh embodiment of the present invention.

FIG. 14 is a top view of an integrated switch 400 according to an eleventh embodiment of the present invention. A component similar to the component of the switch 10 of the first embodiment bears the same reference numeral as the switch 10 of the first embodiment shown in FIGS. 1A, 1B, 2A and 2B. Moreover, in the present embodiment, explanation of the configuration and operation similar to the first embodiment will be partially omitted, and different configuration and different operation from the first embodiment will be explained in particular.

The integrated switch 400 includes the substrate 22 and a plurality of switches 10 provided on the substrate 22. Each of the switches 10 includes the first terminal 46, the second terminal 26 and the third terminal 28 which confront the first terminal 46, the driving means 70 for driving the first terminal 46 in the direction of the second terminal 26 and the third terminal 28, and the electrostatic coupling section 72 including the first electrode 50 and second electrode, which confront each other, for attracting the first terminal 46 in the direction of the second terminal 26 and the third terminal 28 by electrostatic force.

In the present embodiment, the plurality of switch sections are formed on the first substrate 200 by the same manner as it has been explained with reference to FIGS. 12A to 12G and FIGS. 13A to 13D according to the tenth embodiment. Furthermore, the plurality of supports are formed on the second substrate 22 similarly. Next, the first substrate 200 and the second substrate 22 are bonded to manufacture the switches 10 so that the first terminal 46 confronts the second terminal 26 and the third terminal 28 and the first electrode 50 confronts the second electrode. In the present embodiment, the first substrate 200 and the second substrate 22 are cut so that the cut substrates include the plurality of switches 10.

At this time, the integrated circuit device is formed by connecting a plurality of conductor sections in the plurality of switches using wire bonding etc. Alternatively, the integrated circuit device is formed by forming the conductor sections on the substrate so that the plurality of switches share the conductor section. Alternatively, the integrated circuit device is formed by providing elements, such as a transistor, a resistor, and a capacitor, and at least one or more of the switches to form a desired circuit on the substrate.

In the present embodiment, as shown in FIG. 14, the second terminal 26 of one of the switches 10 and the second terminal 26 of the other one of the switches 10 are connected by the conductor section, so that the plurality of switches 10 is integrated.

Figure 15:
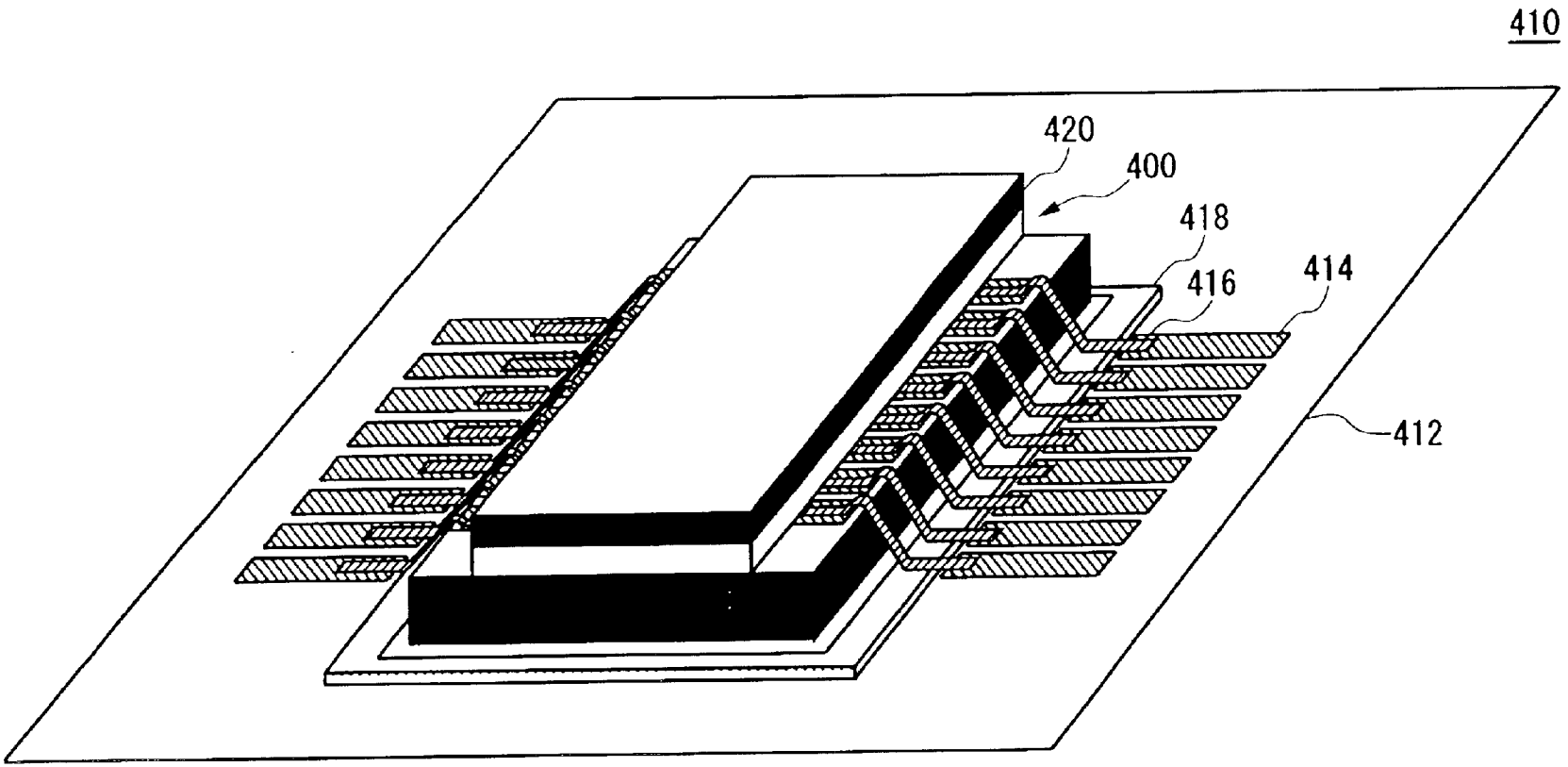
FIG. 15 is a perspective view of an integrated circuit device in which the integrated switch shown in FIG. 14 is packaged.

FIG. 15 is a perspective view of an integrated circuit device in which the integrated switch 400 shown in FIG. 14 is packaged. An integrated circuit device 410 includes the integrated switch 400 shown in FIG. 14, a printed circuit board 412, printed wirings 414 formed on the printed circuit board 412, a resin substrate 418 provided on the printed circuit board 412, and a glass substrate 420 provided on the integrated switch. The integrated circuit device 410 further includes lead wires 416 for connecting the first terminal 46, the second terminal 26, the third terminal 28, and the printed wirings 414 of the integrated switch 400 with one another.

Moreover, since the switch according to the present embodiment uses the driving means 70 in order to close the switch, driver voltage of the switch is reduced compared with the switch which is opened and closed by electrostatic force only. Furthermore, since the switch 10 according to the present embodiment uses driving means 70 in order to close the switch, electrode area of the electrostatic coupling section 72 is reduced, and consequently the switch is miniaturized and highly integrated.

Twelfth Embodiment

Figure 16A:
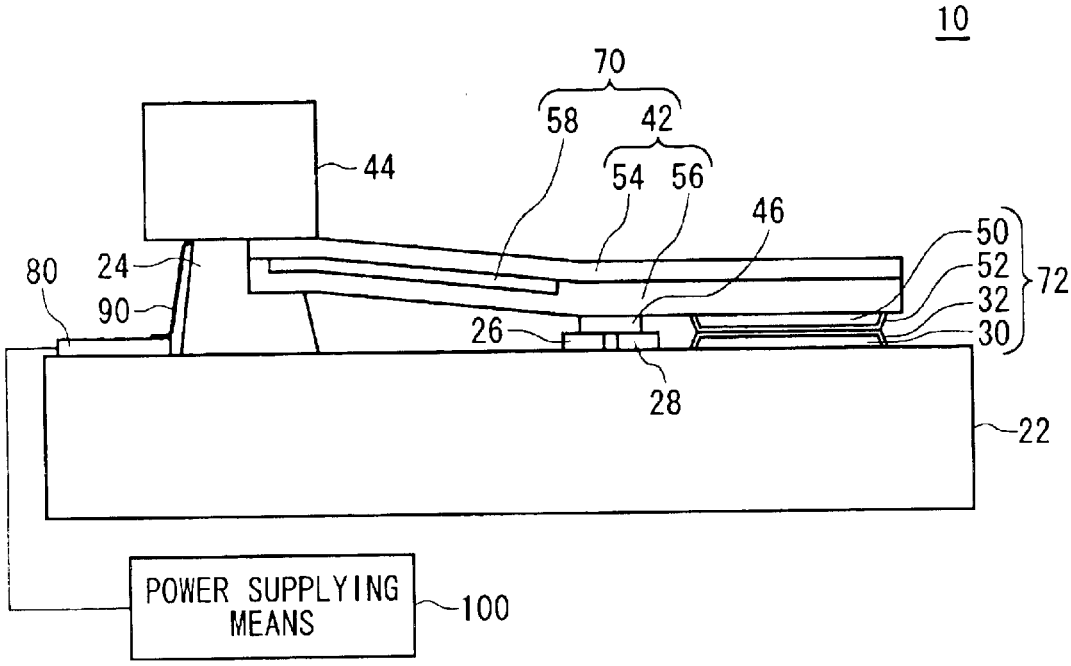
FIGS. 16A and 16B are cross sectional views of the switch according to a twelfth embodiment of the present invention.
Figure 16B:
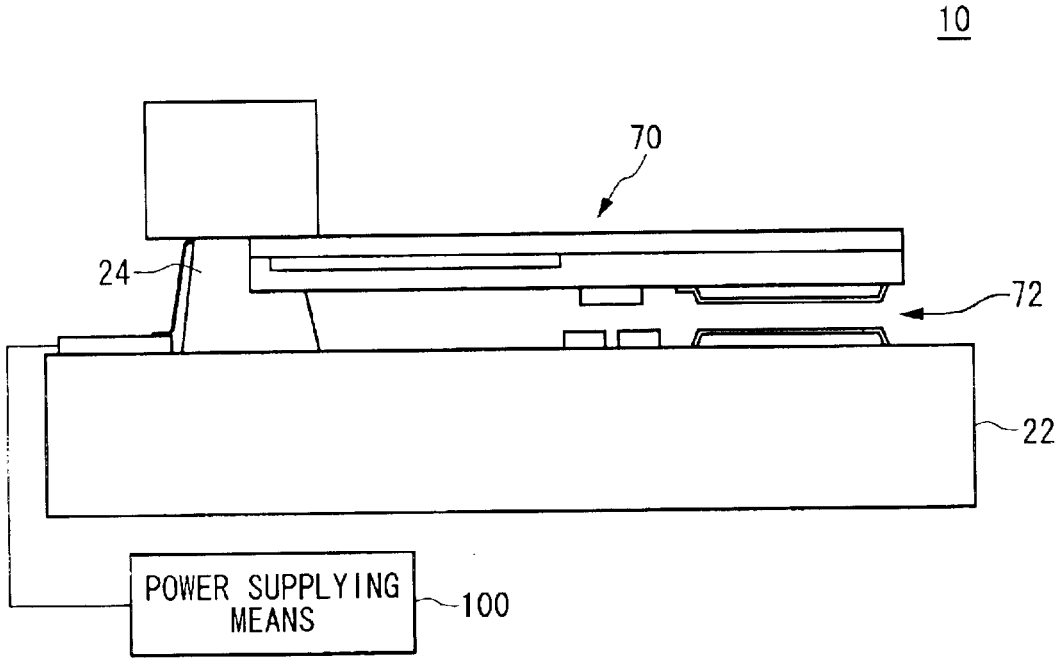

FIGS. 16A and 16B are cross sectional views exemplary showing the switch 10 according to a twelfth embodiment of the present invention. In the first embodiment to the eleventh embodiment, although the normally-open switch has been explained where the switch is normally open when the driving means 70 drives the first terminal 46 in the direction of the second terminal 26 and the third terminal 28, the switch may be a normally-closed switch where the switch is normally closed when the driving means 70 drives the first terminal 46 in the direction opposite to the second terminal 26 and the third terminal 28. In the present embodiment, a normally-closed switch, which has the similar configuration to the switch 10 according to the first embodiment, will be explained.

FIG. 16A is a cross sectional view of the switch 10 being closed. FIG. 16B is a cross sectional view of the switch 10 being opened. A component similar to the component of the switch 10 of the first embodiment bears the same reference numeral as the switch 10 of the first embodiment shown in FIGS. 1A, 1B, 2A and 2B. Moreover, in the present embodiment, explanation of the configuration and operation similar to the first embodiment will be partially omitted, and different configuration and different operation from the first embodiment will be explained in particular.

The switch 10 includes the first terminal 46, the second terminal 26 and the third terminal 28 confronting the first terminal 46, the driving means 70 for driving the first terminal 46 in the direction opposite to the second terminal 26 and the third terminal 28, and the electrostatic coupling section 72 including the first electrode 50 and the second electrode 30, which confront each other, for attracting the first terminal 46 in the direction of the second terminal 26 and the third terminal 28 by electrostatic force. The driving means 70 includes the moving section 42 which holds the first terminal 46 and is driven in the direction opposite to the second terminal 26 and the third terminal 28.

In the present embodiment, the driving means 70 includes the first component 54, the second component 56, and the heater 58 for heating the first component 54 and the second component 56. The first component 54 is made of material having coefficient of thermal expansion smaller than the material which constitutes the second component 56. For example, it is desirable that the first component 54 is made of material having comparatively low coefficient of thermal expansion, such as silicon oxide, silicon, silicon nitride, or aluminum oxide. It is preferable that the second component is made of material having comparatively high coefficient of thermal expansion, such as aluminum, nickel, nickel iron, palladium copper silicon, or resin.

Operation of the switch 10 according to the present embodiment will be explained. As shown in FIG. 16A, the supporting section 24 supports the moving section 42 so that the first terminal 46 contacts the second terminal 26 and the third terminal 28. Therefore, since the second terminal 26 and the third terminal 28 are connected electrically, the signal supplied to the second terminal 26 is supplied to the third terminal 28 through the first terminal 46. Here, the contact force between the first terminal 46, and the second terminal 26 and the third terminal 28 increases by the electric power supply means 100 supplying voltage to the electrostatic coupling section 72. Therefore, contact resistance between the first terminal 46, and the second terminal 26 and the third terminal 28 is controlled high or low. Moreover, the first terminal 46 and the second terminal 26, and the first terminal 46 and the third terminal 28 are in contact with each other uniformly.

When the switch 10 is going to be opened, the electric power supply means 100 stops the voltage having been supplied to the electrostatic coupling section 72. Thereby, the electrostatic force between the first electrode 50 and the second electrode 30 of the electrostatic coupling section 72 disappears. Moreover, the electric power supply means 100 supplies current to the heater 58 of the driving means 70. Then, the first component 54 and the second component 56 are heated by the heater 58. Since the coefficients of thermal expansion are different from each other, the second component 56 expands more than the first component 54 by heating them. Consequently, as shown in FIG. 16B, the moving section 42 is driven in the direction opposite to the substrate 22. Consequently, the first terminal 46 separates from the second terminal 26 and the third terminal 28, and the signal having been supplied to the second terminal 26 is no longer supplied to the third terminal 28.

When the switch 10 is going to be closed, the electric power supply means 100 stops the current having been supplied to the heater 58 of the driving means. The first component 54 and the second component 56 which have been expanded by being heated are expanded and contracted to the size before the heating.

Consequently, the first terminal 46 contacts with the second terminal 26 and the third terminal 28, and the signal supplied to the second terminal 26 is supplied to the third terminal 28 through the first terminal 46.

Figure 17A:
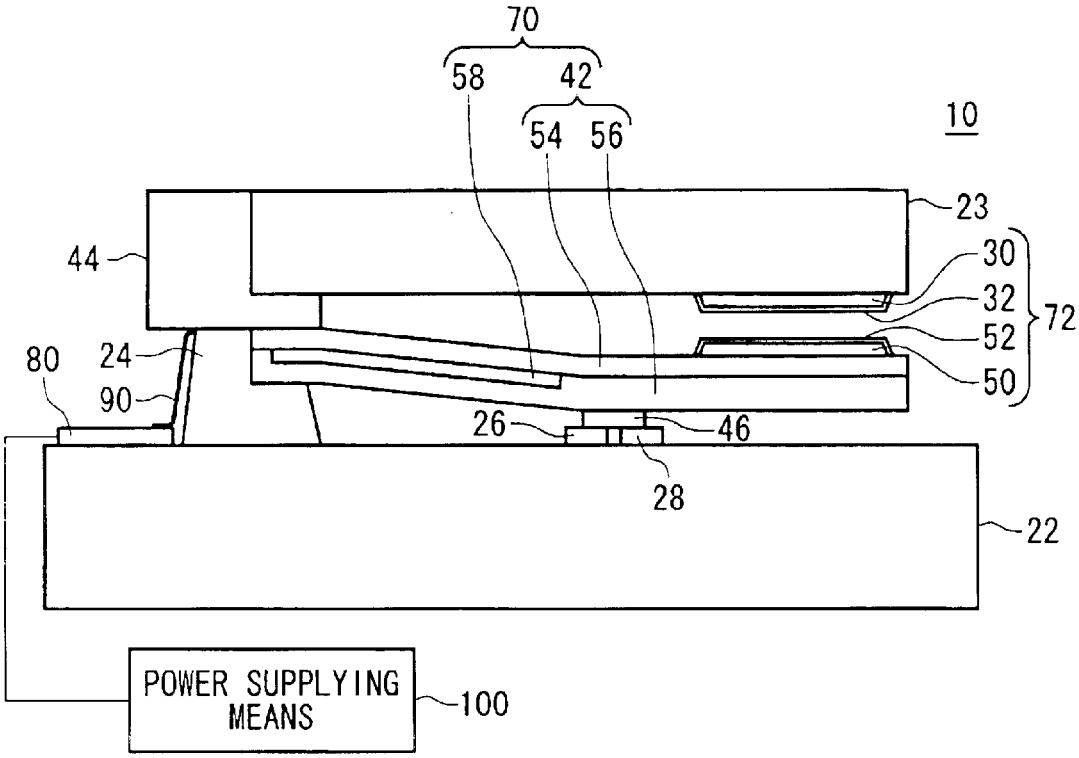
FIGS. 17A and 17B are cross sectional views of the switch according to a thirteenth embodiment of the present invention.
Figure 17B:
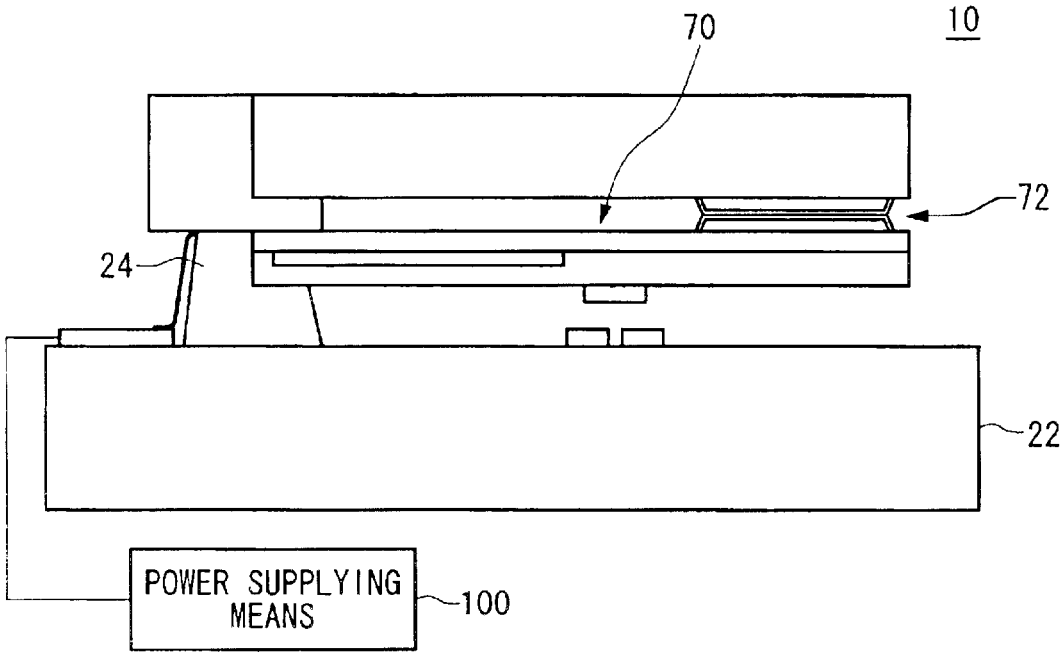

FIGS. 17A and 17B are cross sectional views exemplary showing the switch 10 according to the thirteenth embodiment of the present invention. The switch 10 according to the present embodiment is a normally-closed switch. FIG. 17A is a cross sectional view of the switch 10 being closed. FIG. 17B is a cross sectional view of the switch 10 being open. A component similar to the component of the switch 10 of the first embodiment bears the same reference numeral as the switch 10 of the first embodiment shown in FIGS. 1A, 1B, 2A and 2B. Moreover, in the present embodiment, explanation of the configuration and operation similar to the first embodiment will be partially omitted, and different configuration and different operation from the first embodiment will be explained in particular.

The switch 10 includes the first terminal 46, the second terminal 26 and the third terminal 28 confronting the first terminal 46, the driving means 70 for driving the first terminal 46 in the direction opposite to the second terminal 26 and the third terminal 28, and the electrostatic coupling section 72 including the first electrode 50 and the second electrode 30, which confront each other, for attracting the first terminal 46 in the direction of the second terminal 26 and the third terminal 28 by electrostatic force. The driving means 70 includes the moving section 42 which holds the first terminal 46 and is driven in the direction opposite to the second terminal 26 and the third terminal 28.

Moreover, the switch 10 is provided on the substrate 22 and above the substrate 22, and further includes the supporting section 24 for supporting the moving section 42, the supported section 44 for fixing the moving section 42 to the supporting section 24, the electric power supplying means 100 for supplying electric power to at least either the driving means 70 or the electrostatic coupling section 72, the lead wire section 80 and the connection wiring 90 for connecting the driving means 70 and the electrostatic coupling section 72 with the electric power supplying means 100, and a substrate 23 held by the supported section 44.

The substrate 23 is provided so as to confront the substrate 22 across the moving section 42. It is preferable that the substrate 23 is provided substantially parallel with the substrate 22. Moreover, the second terminal 26, the third terminal 28, and the lead wire section 80 are formed on the substrate 22. The second electrode 30 is formed on the substrate 23. The moving section 42 holds the first terminal 46 so that it confronts the second terminal 26 and the third terminal 28, and it holds the first electrode 50 so that the first electrode 50 confronts the second electrode 30. That is, the moving section 42 holds the first electrode 50 on the back side of the surface confronting the second terminal 26 and the third terminal 28. Furthermore, it is preferable that the moving section 42 holds the first terminal 46 on the back side of the first electrode 50 and between the first electrode 50 and the supporting section 24. Moreover, it is preferable that an end of the moving section 42 is fixed to the supporting section 24 and the other end of the moving section 42 holds the first electrode.

In the present embodiment, the driving means 70 includes the first component 54, the second component 56, and the heater 58 for heating the first component 54 and the second component 56. It is desirable that the first component 54 is made of material having lower coefficient of thermal expansion than the material which constitutes the second component 56. It is preferable that the first component 54 is made of material having comparatively low coefficient of thermal expansion, such as silicon oxide, silicon, silicon nitride, or aluminum oxide. It is preferable that the second component is made of material having comparatively high coefficient of thermal expansion, such as aluminum, nickel, nickel iron, palladium copper silicon, or resin.

Operation of the switch 10 according to the present embodiment will be explained. As shown in FIG. 17A, the supporting section 24 supports the moving section 42 so that the first terminal 46 contacts the second terminal 26 and the third terminal 28. Therefore, since the second terminal 26 and the third terminal 28 are connected electrically, the signal supplied to the second terminal 26 is supplied to the third terminal 28 through the first terminal 46.

When the switch 10 is going to be opened, the electric power supply means 100 supplies current to the heater 58 of the driving means 70. Then, the first component 54 and the second component 56 are heated by the heater 58. Since the coefficients of thermal expansion are different from each other, the second component 56 expands more than the first component 54 by heating them. Consequently, as shown in FIG. 17B, the moving section 42 is driven in the direction opposite to the substrate 22. Consequently, the first terminal 46 separates from the second terminal 26 and the third terminal 28, and the signal having been supplied to the second terminal 26 is no longer supplied to the third terminal 28.

When the moving section 42 is driven in the direction of the substrate 23 and the first terminal 46 separates from the second terminal 26 and the third terminal 28, the electric power supply means 100 supplies voltage to the electrostatic coupling section 72. Alternatively, when the moving section 42 is driven in the direction of the substrate 23, and a part where the first electrode 50 of the moving section 42 is provided approaches a part where the second electrode 30 of the substrate 23 is provided so that they are under the influence of the electrostatic attraction, the electric power supply means 100 supplies voltage to the electrostatic coupling section 72. By supplying voltage to the electrostatic coupling section 72, electrostatic force occurs between the first electrode 50 and the second electrode 30 of the electrostatic coupling section 72. The electrostatic coupling section 72 attracts the moving section 42 in the direction of the substrate 23 by the electrostatic force between the first electrode 50 and the second electrode 30. Alternatively, the electric power supply means 100 stops the current having been supplied to the driving means 70 while supplying voltage to the electrostatic coupling section 72.

When the switch 10 is going to be closed, the electric power supply means 100 stops the voltage having been supplied to the electrostatic coupling section 72. Thereby, the electrostatic force between the first electrode 50 and the second electrode 30 of the electrostatic coupling section 72 disappears. Therefore, the moving section 42 moves in the direction opposite to the substrate 23. Consequently, the first terminal 46 contacts the second terminal 26 and the third terminal 28, and the signal supplied to the second terminal 26 is supplied to the third terminal 28.

As described above, since the switch 10 according to the present embodiment keeps the switch being opened by electrostatic force using the plurality of components, of which the coefficients of thermal expansion are different, and the heater for heating the components, as driving force to keep the switch being opened, electric power consumption of the switch is reduced extremely.

Moreover, since the switch 10 according to the present embodiment uses the driving means 70 in order to open the switch, driver voltage of the switch is reduced compared with the switch which is opened and closed by electrostatic force only. Furthermore, since the switch 10 according to the present embodiment uses driving means 70 in order to open the switch, electrode area of the electrostatic coupling section 72 is reduced, and consequently the switch is miniaturized and highly integrated.

Although the present invention has been described by way of an exemplary embodiment, it should be understood that those skilled in the art might make many changes and substitutions without departing from the spirit and the scope of the present invention. It is obvious from the definition of the appended claims that embodiments with such modifications also belong to the scope of the present invention.

As described above, according to the present invention, electric power consumption required to keep a switch open or closed is reducible.

What is claimed is:

1. A switch for electrically connecting a first terminal with a second terminal confronting the first terminal, comprising:

a driving mean having a fixed end and a free end in a longitudinal direction for driving said first terminal in the direction of said second terminal; and an electrostatic coupling section including a first electrode and a second electrode confronting each other for attracting said first terminal in the direction of said second terminal by electrostatic force, said electrostatic coupling section being disposed closer to said free end of said driving mean than a location of the first terminal.

2. The switch as claimed in claim 1, wherein said driving means drives said first terminal in the direction of said second terminal by an electric power supply.

3. The switch as claimed in claim 1, further comprising electric power supply means for supplying electric power to at least either said driving means or said electrostatic coupling section.

4. The switch as claimed in claim 1, further comprising a third terminal confronting said first terminal, wherein said first terminal connects said second terminal with said third terminal electrically by said first terminal contacting said second terminal and said third terminal.

5. The switch as claimed in claim 1 wherein, said driving means comprises a moving section which hold said first terminal and is driven in the direction of said second terminal.

6. The switch as claimed in claim 5, further comprising:

a wiring provided at said moving section with one end of said wiring connecting with said first terminal; and a third terminal connecting with another end of said wiring, wherein said first terminal connects said second terminal with said third terminal electrically by contacting said second terminal.

7. The switch as claimed in claim 5, further comprising:

a wiring provided at said moving section with one end of said wiring connecting with said first terminal;

a third terminal connecting with another end of said wiring; and a fourth terminal confronting said third terminal, wherein said driving means drives said third terminal in the direction of said fourth terminal, and said electrostatic coupling section further comprises a third electrode and a fourth electrode confronting each other for attracting said third terminal in the direction of said fourth terminal by electrostatic force.

8. The switch as claimed in claim 5, further comprising a supporting section for supporting said moving section, wherein said first terminal is provided between said supporting section and said first electrode.

9. The switch as claimed in claim 5, further comprising a supporting section for supporting said moving section, wherein said first electrode is provided between said supporting section and said first terminal.

10. The switch as claimed in claim 5, further comprising two of said electrostatic coupling sections, wherein said first electrodes of said two electrostatic coupling sections are provided in a direction perpendicular to a longitudinal direction of said moving section on both sides of said first terminal.

11. The switch as claimed in claim 5, wherein the moving section comprises at least one narrower part including the first terminal.

12. The switch as claimed in claim 5, wherein said moving section comprises a plurality of components having different coefficients of thermal expansion from one another.

13. The switch as claimed in claim 5, wherein said moving section comprises shape memory alloy.

14. The switch as claimed in claim 13, wherein said driving means further comprises a heater for heating said shape memory alloy.

15. The switch as claimed in claim 5, further comprising:

a substrate on which said second terminal is provided; and a supporting section provided on said substrate for supporting said moving section.

16. The switch as claimed in claim 15, wherein said driving means further comprises first magnetic material provided at said moving section, and second magnetic material provided at said substrate.

17. The switch as claimed in claim 1, wherein said driving means comprises a heater for heating a plurality of components in which said coefficients of thermal expansion are different form one another.

18. The switch as claimed in claim 1, wherein said driving means comprises a piezoelectric element.

19. A switch for electrically connecting a first terminal with a second terminal confronting said first terminal, comprising:

a driving mean having a fixed end and a free end in a longitudinal direction for driving said first terminal in the direction opposite to said second terminal; and an electrostatic coupling section including a first electrode and a second electrode confronting each other for attracting said first terminal in the direction of said second terminal by electrostatic force, said electrostatic coupling section being disposed closer to said free end of said driving mean than a location of the first terminal.

20. An integrated circuit device in which a plurality of switches for electrically connecting a first terminal with a second terminal are provided on a substrate, wherein said switches comprises:

a driving mean having a fixed end and a free end in a longitudinal direction for driving said first terminal in the direction of said second terminal; and an electrostatic coupling section including a first electrode and a second electrode confronting each other for attracting said first terminal in the direction of said second terminal by electrostatic force, said electrostatic coupling section being disposed closer to said free end of said driving mean than a location of the first terminal.

* * * * *